US005181705A

United States Patent [19]

Ueda et al.

[11] Patent Number: 5,181,705

[45] Date of Patent: Jan. 26, 1993

[54] SHEET DISCHARGING DEVICE THAT CHOOSES A SHEET DISCHARGING SPEED ACCORDING TO THE SHEET'S LENGTH OR RIGIDITY

[75] Inventors: Noriyoshi Ueda, Yokohama; Yuji Takahashi; Makoto Kitahara, both of Tokyo, all of Japan

[73] Assignee: Canon Kabushiki Kaisha, Tokyo, Japan

[21] Appl. No.: 370,907

[22] Filed: Jun. 23, 1989

[30] Foreign Application Priority Data

| | | | |
|---|---|---|---|
| Jun. 23, 1988 | [JP] | Japan | 63-156448 |
| Aug. 12, 1988 | [JP] | Japan | 63-201084 |
| Sep. 29, 1988 | [JP] | Japan | 63-242390 |

[51] Int. Cl.[5] ..... G65H 43/00

[52] U.S. Cl. ..... 271/3; 271/176; 271/202

[58] Field of Search ..... 271/3, 3.1, 110, 111, 271/176, 199, 202, 207, 258; 355/311, 321, 322

[56] References Cited

U.S. PATENT DOCUMENTS

| | | | |
|---|---|---|---|
| 4,595,279 | 6/1986 | Kuru et al. | 355/311 |
| 4,693,461 | 9/1987 | Takahashi | 271/176 |
| 4,696,463 | 9/1987 | Nakazato et al. | 271/176 |
| 4,763,160 | 8/1988 | Honjo | 355/311 |
| 4,787,620 | 11/1988 | Goldkuhle | 271/111 |
| 4,825,248 | 4/1989 | Honjo et al. | 271/111 |
| 4,849,915 | 7/1989 | Worsley et al. | 271/258 |
| 5,116,042 | 5/1992 | Hamanaka | 271/176 |

FOREIGN PATENT DOCUMENTS

| | | | |
|---|---|---|---|
| 12248 | 2/1981 | Japan | 271/199 |
| 56445 | 5/1981 | Japan | 271/110 |
| 157668 | 9/1983 | Japan | 271/199 |
| 93166 | 4/1987 | Japan | 271/207 |
| 139821 | 6/1988 | Japan | 271/110 |
| 298332 | 12/1988 | Japan | 355/321 |

OTHER PUBLICATIONS

Church, et al. "Dynamic Sheet Length Sensing", *IBM Technical Disclosure Bulletin*, vol. 18, No. 2, pp. 330–331 (Jul. 1975).

*Primary Examiner*—Robert P. Olszewski
*Assistant Examiner*—Steven M. Reiss
*Attorney, Agent, or Firm*—Fitzpatrick, Cella, Harper & Scinto

[57] ABSTRACT

A sheet discharging device has a sheet support, a sheet discharge part, a detector and means for controlling the transport condition at the time of sheet discharge. The detector detects the length or characteristic of a sheet before its discharge. Thus a transport condition of a sheet can be changed at the time of its discharge dependent on its length or characteristic and the sheet is discharged adjustably.

70 Claims, 16 Drawing Sheets

SHEET DISCHARGING DEVICE THAT CHOOSES A SHEET DISCHARGING SPEED ACCORDING TO THE SHEET'S LENGTH OR RIGIDITY

BACKGROUND OF THE INVENTION

Field of the Invention

This invention relates to a sheet discharging device, which, after processing, automatically discharges copy sheets from an image forming device such as a copying machine, printer etc. or original sheets from automatic original transport devices or the like which are attached to the above image forming devices. In more detail, it relates to the variable control of discharge conditions in accordance with changes of sheet characteristics such as sheet size.

Until now, the automatic original transport devices have had a tray for discharged paper mounted above the platen of the image forming part. The original, after it is processed, makes a U-turn and is discharged and placed on the tray. In this case, the speed of discharging an original is fixed at the same speed as other transport speeds. Additionally, the tray is mounted slantingly to some degree and the discharged original slides of its own weight to be aligned properly. Examples of publicly known original transport devices are explained as follows.

An original transport device 101*a*, shown in FIG. 26, separates the originals loaded on a paper supply tray 111' having a separation device 115', 116' and delivers them one by one to a transport belt 107, which places them at a fixed position on a platen 103 where they are processed. The originals are then transported through a discharging path 129 and a pair of discharging rollers 127 onto a tray 110.

Other original transport devices are shown in FIGS. 27 and 28. These devices are placed above a copying machine 102 (FIG. 27). Thus, as shown, a transport belt 107, 403 is wound over a platen 103, 404 between a drive roller and an idler roller. A tray 111, 401 for paper supply is loaded with originals M. Downstream of the tray 111, 401 are placed a transport roller 115', 405 which rotates counterclockwise and transports originals M one by one, a separation roller 116', 402 which rotates counterclockwise and separates originals M, and a pair of transport rollers 117, 407. The above form a supply path which transports originals M onto the platen 103, 404. After copy process is finished, originals M are discharged onto a tray 110 for discharged papers or returned to the tray 401 for paper supply.

Recently there has been a demand for a speed-up of the processing procedure. Accordingly, the speed of transport and discharge of originals has been increased, and together with it the slant of the tray for discharged paper and the space that it occupies increased too. Therefore, there appear the devices in which for example, as described in such prior art as U.S. Pat. Nos. 4,696,463 or 4,693,461, discharge speed is slowed down compared with other transport speeds so that the slant of the tray for discharged paper can be reduced and the originals can be aligned properly.

However, in case of discharging an original onto the tray for discharged papers, the original itself may slide in various directions on the surface of the tray or of an original that was previously discharged. Additionally, the longer the discharge length, the greater the sliding resistance. Therefore, in case the discharging speed is constantly lowered to a certain level, if that speed is adjusted for originals of a small size, owing to the increase of the sliding resistance, originals of large size make folds or rolls and are placed in disorder. On the other hand, if the discharging speed is adjusted for originals of large size, originals of small size fly too far and are scattered in disorder.

On the other hand, if the discharge speed is not changed, the originals of large size may turn up and jam because of air resistance and form coils, or they may collide with the tray for paper supply (the type of FIG. 27) causing jamming or paper damage. Such defects appear more frequently especially when the transport speed gets high, when the original is curled upward from the beginning, when the original is easy to bend as when it has high transparency as when it is thin. Consequently, at a fixed discharging speed, the originals cannot be aligned simultaneously for both large and small size or for different characteristics. The above defects appeared not only in the original transport device, but also in a copy paper discharge part in a primary body of a copying machine, a transport part which discharges sheets to an intermediate tray for both sided or multiple copying that is placed within a copying machine or in a discharge part for each bin of a sorter which is connected to the primary body of a copying machine. In these devices, turning up, coiling and jamming of sheet materials (which mean originals, copy materials etc. made of papers or materials other than papers) can also occur.

SUMMARY OF THE INVENTION

An object of the present invention is to provide a sheet discharging device which can achieve constant alignment of sheets on the discharging tray regardless of the sheet sizes or other characteristics at the time of sheet discharge.

To achieve the above object a sheet discharging device which in sequence discharges sheets in order on a tray for discharged papers by a transporting motor, comprises a detector which detects the length of a sheet S measured in a direction of its transport or detects its characteristic before its discharge and control means which controls the transport condition at the time of sheet discharge so that the transport condition at the time of sheet discharge can be changed dependent on the length measured in a direction of its transport or characteristics of the sheet.

Characteristics of sheets mentioned above mean transparency, thickness, size etc. of sheet materials. With reference with FIG. 9, when the original M is detected by a detector to be larger than a predetermined size, it can be discharged at a lower speed than the original which is smaller than the predetermined size. Further, when the original is detected by the detector to be larger than the predetermined size, it can be discharged at an early stage at a lower speed than the original which is smaller than the pre-determined size and then at a later stage, at a higher speed than at the early stage. Further when the original M is detected by the detector to be larger than the pre-determined size, it can be discharged at an early stage at a lower speed than the original which is smaller than the pre-determined size, at an intermediate stage at a higher speed than at the early stage and at a last stage, at a lower speed than the intermediate stage.

BRIEF DESCRIPTION OF THE DRAWINGS

The structure, functions, and advantages of the present invention will become apparent from the following detailed description of the preferred embodiment and the appended drawings in which.

DETAILED DESCRIPTION OF THE PREFERRED EMBODIMENT

According to the structure of the present invention, during the process of transporting a sheet S by the transporting motor, the size of the sheet in a direction of transport is detected by a detector. At the time that the transporting motor discharges a sheet S onto a tray for discharged papers, the transport conditions such as discharging speed and timing for speed reduction can be variably controlled according to the sheet size by controlling means. Consequently the sheet S of any size can be aligned favorably on the tray for discharged papers.

Further, since turning up or coiling of sheet materials is concerned with characteristics as thickness etc., their turning up, coiling and jamming can be prevented by slowing down or modifying discharge speed etc. of sheet materials according to their characteristics.

Figure 1:
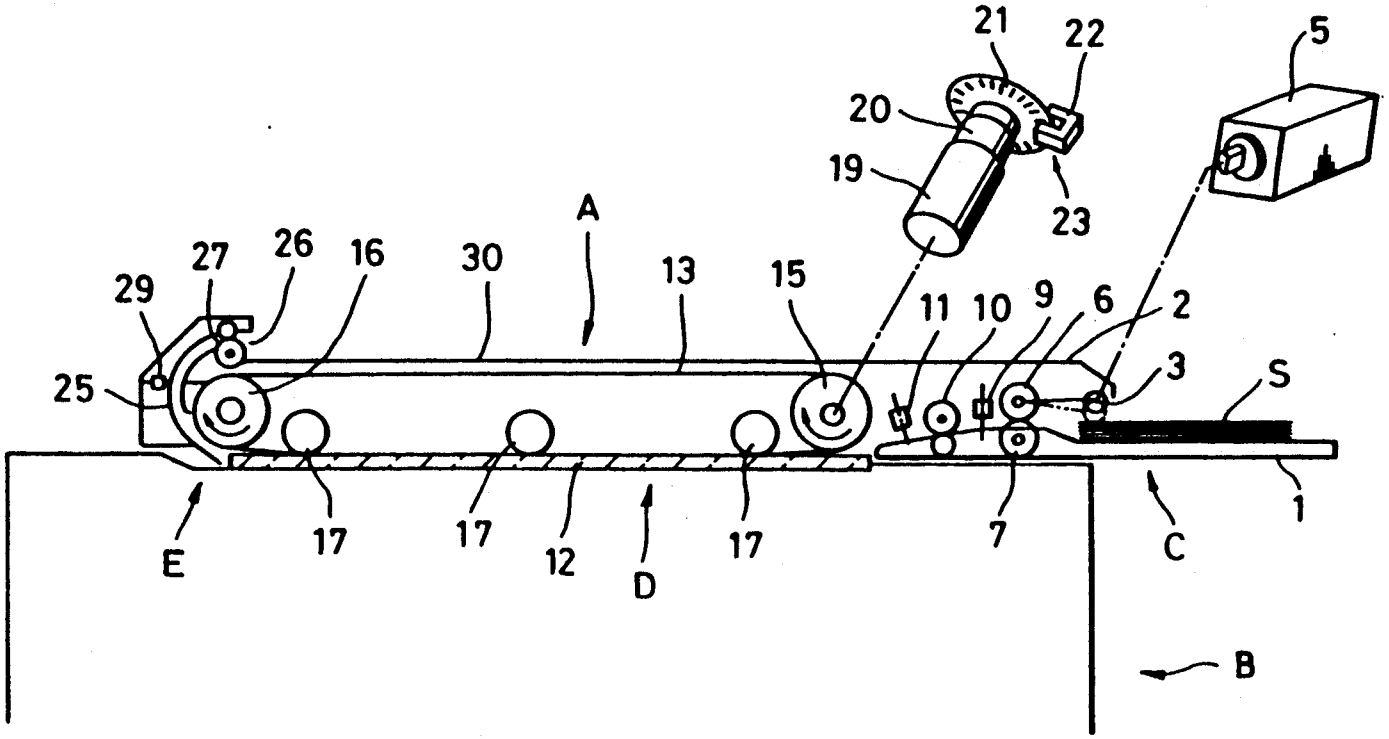
FIG. 1 is a side view, partially exploded, showing an embodiment which applies the present invention to an automatic original transport device.

With reference to FIG. 1 an example is explained in which the present invention is applied to an automatic original transport device. An automatic original transport device A is mounted above an image forming apparatus B and has a paper supply part C, transport part D and paper discharge part E. In the paper supply part C a tray 1 for supply papers protrudes horizontally from the inside of a device 2 and on the tray 1 a stack of originals S are placed face down. In the inside of the device 2 a pick-up roller 3 can be brought into contact with an end of the originals at their upper side by operation of a solenoid 5 and sends out the uppermost original S. When the roller is withdrawn from the original, it stops sending.

A transport roller 6 which rotates in the transport direction of the original S and a separation roller 7 which rotates in the opposite direction to it are placed ahead of the roller 3 and a separation detector or sensor 9 is placed downstream of the rollers 6 and 7 to detect a leading edge of the original S. Downstream of the sensor 9 a pair of forwarding rollers 10 and a second sensor 11 are placed to forward and detect the leading and trailing edges of the original S.

The transport part D is formed so that at an image forming part forward of the above paper supply part C, a transport belt 13 is wound over a platen 12 between a drive roller 15 driven by motor 19, and an idler roller 16 rotating with it so that the original S is transported between the belt 13 and the platen 12. On the inner side of the belt 13 a plurality of rollers 17 contact the belt under pressure so that they increase by friction the certainty of transport of the originals. A transport-clock-generator 23 comprising a brake 20 for stemming rotation of the motor, a clockdisc 21 having a plurality of slits and a photointerrupter 22 which detects the slits, is also driven by the motor 19.

In the paper discharge part E, downstream of the idler roller 16, a discharge path 25 is provided, which is curved upwardly in a U-form. Further discharge rollers 27 are provided close to a discharge outlet 26 and a sensor 29 for detecting discharged paper is disposed midway of the discharge path 25. Additionally, a tray 30 for discharged papers is provided downstream of the discharge outlet 26 above the device 2, and extends continuously from the outlet 26.

Figure 2:
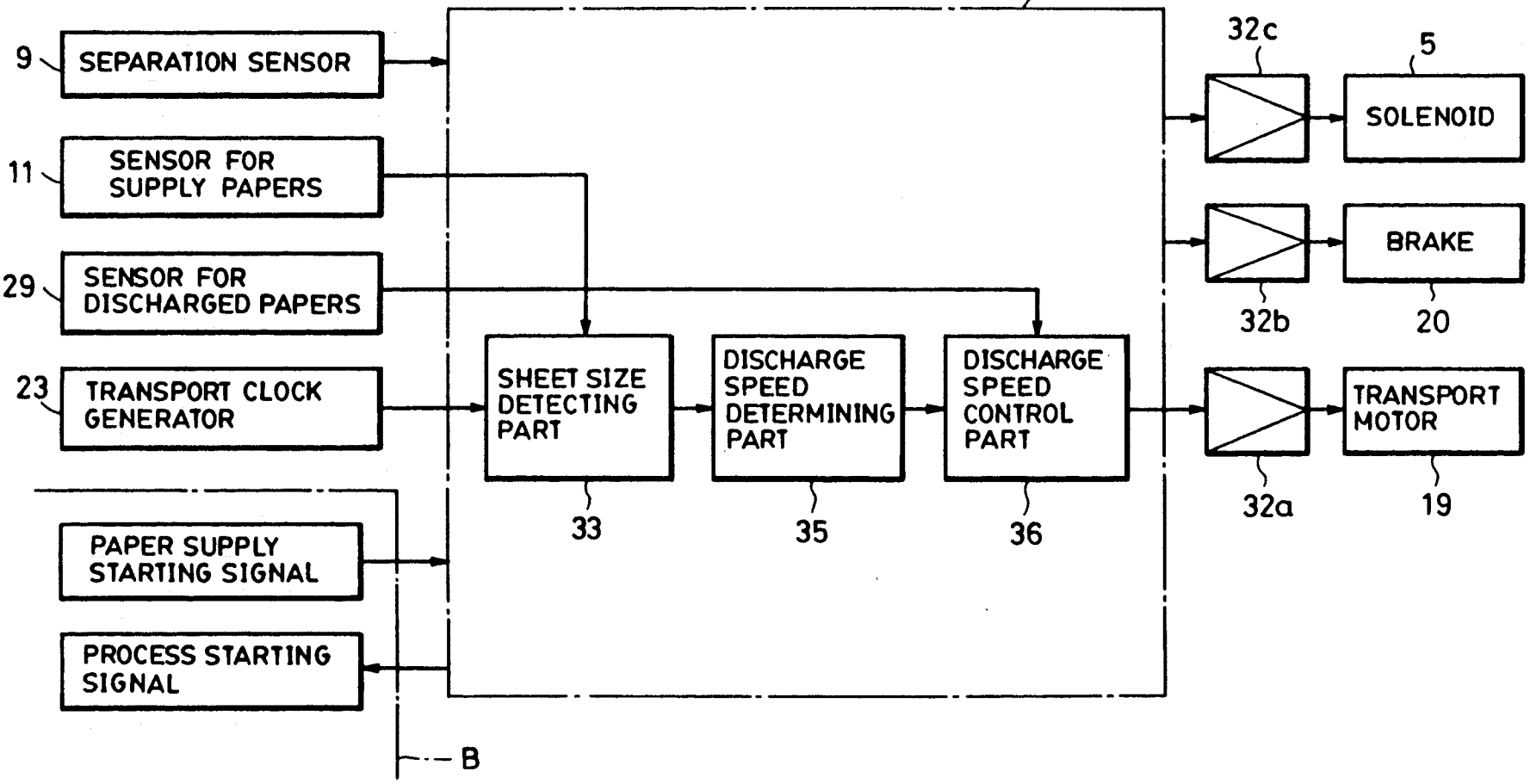
FIG. 2 is a block diagram of a control system.

With reference to FIG. 2 a control system is explained. Numeral 31 designates a control unit such as microcomputer into which a signal indicating the leading edge of an original from the separation sensor 9 is fed, a signal indicating the leading and trailing edges of an original from the sensor 11 of supply papers, a signal of a trailing edge of the original from the discharged paper sensor 29, a pulse signal of the clock generator 23 at the time of transport of an original and a starting signal for paper supply from the image forming apparatus B are inputted and processed. Following receipt of these signals, a drive signal is outputted from the control unit 31 through drivers 32*a*, 32*b* and 32*c* to the transport motor 19, along with a drive signal to the solenoid 5, a braking signal to the brake 20 and a signal to the image forming apparatus B for starting the process.

Here an essential part of the present invention is further explained. The control unit 31 has a sheet size detecting part 33 into which signals from the sensor 11 for paper supply and the clock generator are inputted. The sheet size detecting part 33 counts pulse signals from the clock generator 23 between a leading and a trailing edge signal of the original S made by the sensor 11, detects the length of the originals in the transport direction according to the counted number and judges its size to be small or large. While a size signal is inputted into a discharge speed determining part 35, in this part against a normal discharge speed V1, a discharge speed V3 and a lower discharge speed V2 are set up beforehand in a relation V1>V3>V2. V2 is selected for small size and V3 for large size. When the signal of the trailing edge of the original is inputted from the discharged paper sensor 29 into a discharge speed control part 36, a drive signal of V2 or V3 is outputted to the motor 19.

Therefore, when a starting signal for paper supply is inputted, the pick-up roller 3 (FIG. 1) descends on the stack of the originals S above the tray 1 for supply paper by operation of the solenoid 5, and sends out the top sheet of the originals S. Issuing double originals is hindered by the transport roller 6 and separation roller 7. When the separation sensor 9 detects the leading edge of the original S, the roller 3 ascends and parts from the stack of the original S.

The original S that was sent out is guided by the forwarding roller 10 to the transport belt 13. At this time, if the sensor 11 detects the leading edge of the original S, then counting of pulses generated by the clock generator 23 starts. In the meantime, the original S is transferred further from the transport roller 10 by the belt 13 and horizontally on the platen 12 with its face down. When a number of pulses which is equivalent to the distance from the sensor 11 to the fixed position on the platen 12 is counted, the motor 19 stops and simultaneously the brake operates to stop the motion of the belt 13, so that the original S stops at the particular position on the platen 12 being pressed by the belt 13.

Moreover, at this time, signals of the leading and trailing edges of the original from the sensor 11 and a pulse signal from the clock-generator 23 are inputted into the sheet size detecting part 33 and the size of the original S is detected. The discharge speed V2 or V3 is then selected by the discharge speed determining part 35 according to the size of the original S and is applied to the discharged original so that alignment at the time of discharge is obtained.

Consequently, when the original S stops at the fixed position on the platen 12 as mentioned above, a signal for starting processing is outputted to the image forming apparatus B and an image of the original S is formed. After the process of image forming is finished, the transport motor 19 rotates again at the same transport speed V1 as above by a signal for starting paper supply and the belt 13 starts discharging the original S. At this time, the sides of the original S are reversed through U-turned path 25 and the sheet is discharged from the discharge outlet 26 with its face up, to the tray 30 for discharged papers.

Figure 3:
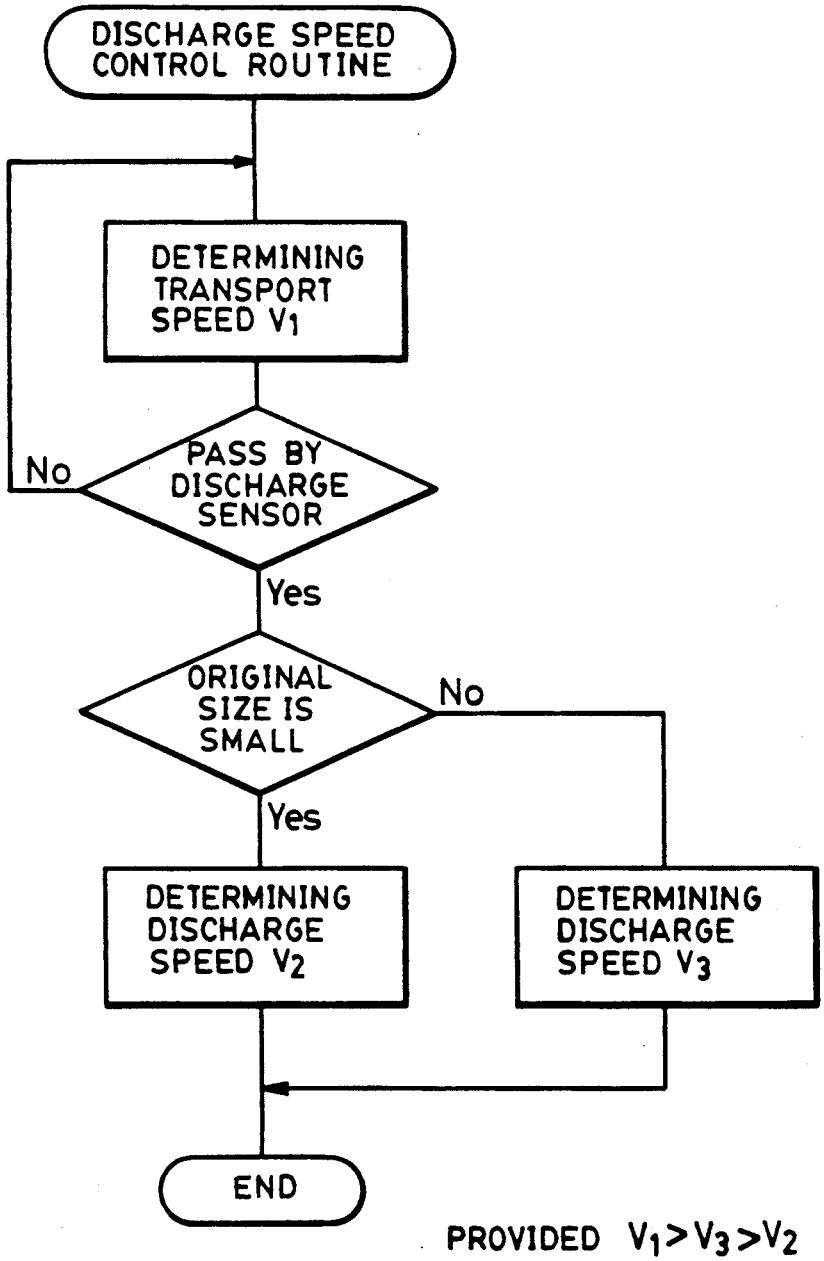
FIG. 3 is a flowchart showing the function of variable control of the discharge speed.

When the sensor 29 for discharged papers detects the trailing edge of the original S during the above discharge, the motor is controlled to a lower speed at the discharge speed control part 36 of the control unit 31. Namely, as shown in the flowchart of FIG. 3, if the size of the original S is small and therefore sliding resistance is small, the lower discharge speed V2 is selected so that the original S is discharged calmly and placed in good alignment on the tray 30 without flying too far. On the other hand, in case the original S is of large size, it is discharged at a higher discharge speed V3 than the above and the original S moves on the tray 30 overcoming greater sliding resistance and is placed without any troubles such as folding.

In the above embodiment if the original is of small size, the discharge speed is changed from V1 to V2 and if the original is of large size, the speed is changed from V1 to V3. However the discharge speed may be also controlled more minutely with many grades or speed levels. For example, the length of the original in the direction of discharge can be classified into three grades based on fixed lengths 11 and 12 (11>12) and the speed is controlled so that the relation between 1 and change of discharge speed is as follows:

| 1 | change of discharge speed |
|---|---|
| 1 ≧ 11 | V1 → V4 |
| 11 > 1 ≧ 12 | V1 → V5 |
| 12 > 1 | V1 → V6 |

(provided V4 > V5 > V6)

Additionally, the speed can be controlled also continuously and lineally.

The above-mentioned are embodiments in which the discharge speed at the time of discharge is variably controlled. The timing of discharge speed reduction can also be variably controlled.

Figure 4:
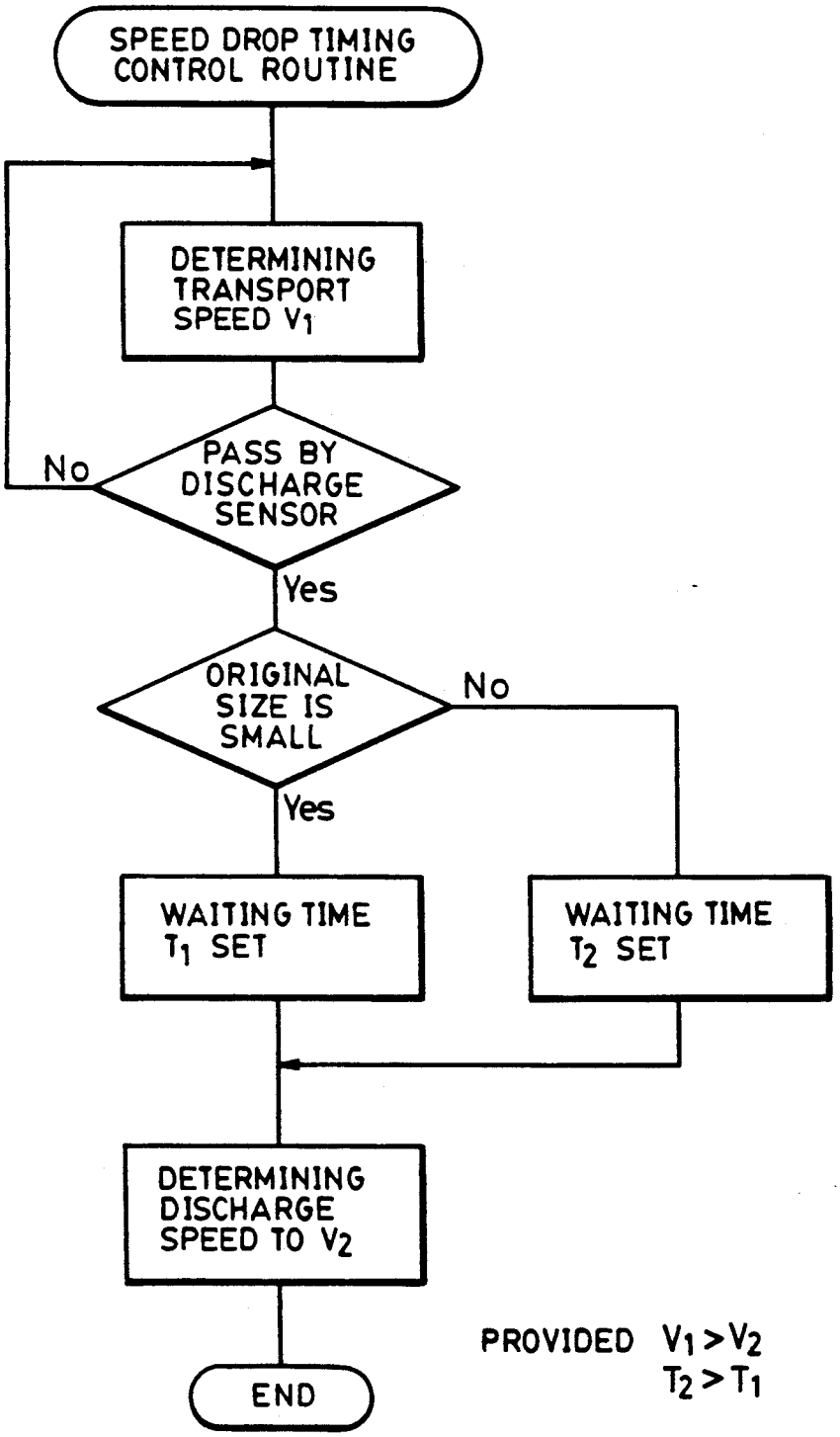
FIG. 4 is a flowchart showing function of variable control speed reduction.

Thus, in case the original S is of small size, in order to obtain a satisfactory discharge condition, its speed can be reduced with early timing and in case of large size, with late timing. As shown in the flowchart of FIG. 4, this means from the point of time when the sensor 29 for discharged papers detects the trailing end of the original S, in case of a small size after the lapse of a shorter waiting time T1 the discharge speed is reduced to a lower speed V2, and in case of a large size, after the lapse of a longer waiting time T2, it similarly is reduced to a lower speed. Consequently, the original can be aligned stably in the tray for discharged papers according to large or small size of the original like the embodiment mentioned before.

In the above embodiment, in case of the original of small size, the timing of the discharge reduction speed is set upon a lapse of the time T1 after the trailing edge of the original passes by the sensor 29 for discharged papers and in case of a large size it is set upon a lapse of a time T2.

However, such timing may be more minutely controlled. For example, the length 1 of the original in the direction of discharge can be classified into three grades based on fixed lengths 11 and 12 (11>12) and the timing is controlled so that the relation between 1 and the timing of discharge speed reduction is as follows:

| 1 | timing of discharge speed reduction |
|---|---|
| 1 ≧ 11 | T3 |
| 11 > 1 ≧ 12 | T4 |
| 12 > 1 | T5 |

(provided T3 > T4 > T5)

Further, while the above-mentioned embodiments relate to the discharge of the original in the automatic original transport devices, it goes without saying that the present invention can also be applied to the discharge of transfer sheets in copying machines, printers and the like.

Figure 5:
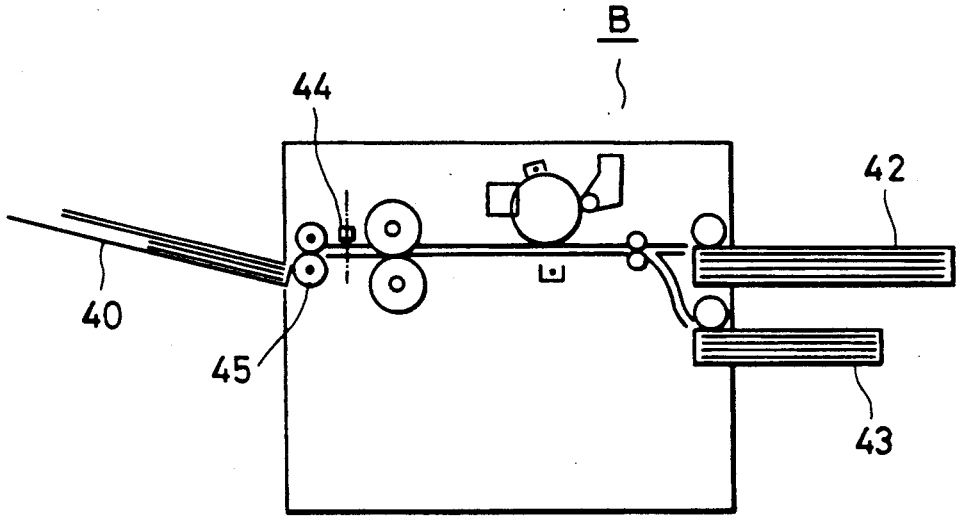
FIG. 5 and FIG. 6 show embodiments which apply the present invention to a paper discharge part in an image forming device.
Figure 6:
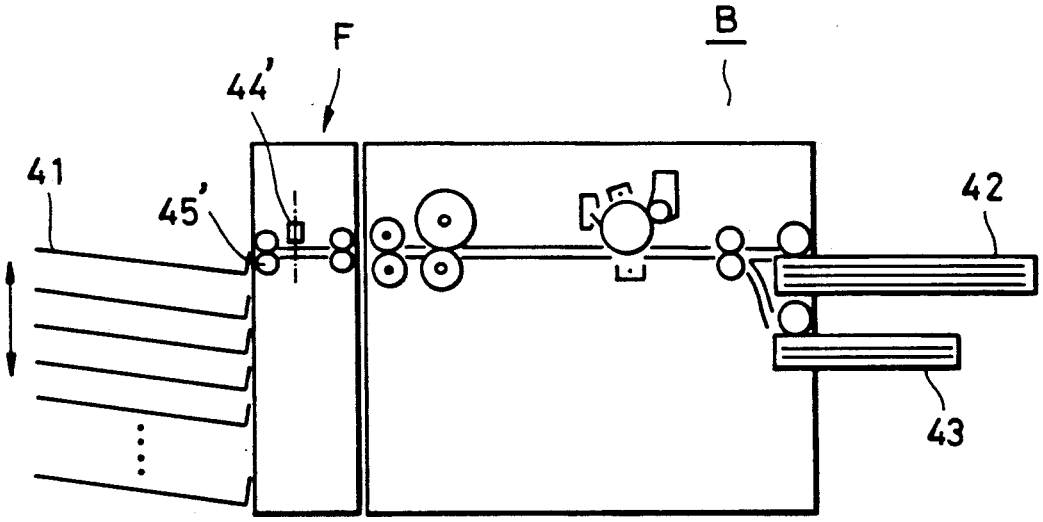

For example, it can be applied to a device for discharged papers 40 in an image forming apparatus B like a copy machine, as shown in FIG. 5, or applied to discharge to a bin 41 in a sheet sorting apparatus F which is connected to a discharge part in the image forming apparatus B, as shown in FIG. 6. In this case the size of a sheet can be determined from a sheet size signal from a cassette 42 or 43 in which sheets of respective sizes are stored, and the discharge speed or timing of discharge speed reduction may be variably controlled by a roller 45 (FIG. 5) or 45' (FIG. 6) for discharging sheets after the sensor 44 (FIG. 5) or 44' (FIG. 6) for discharged sheets detects the passage of a sheet.

Figure 7:
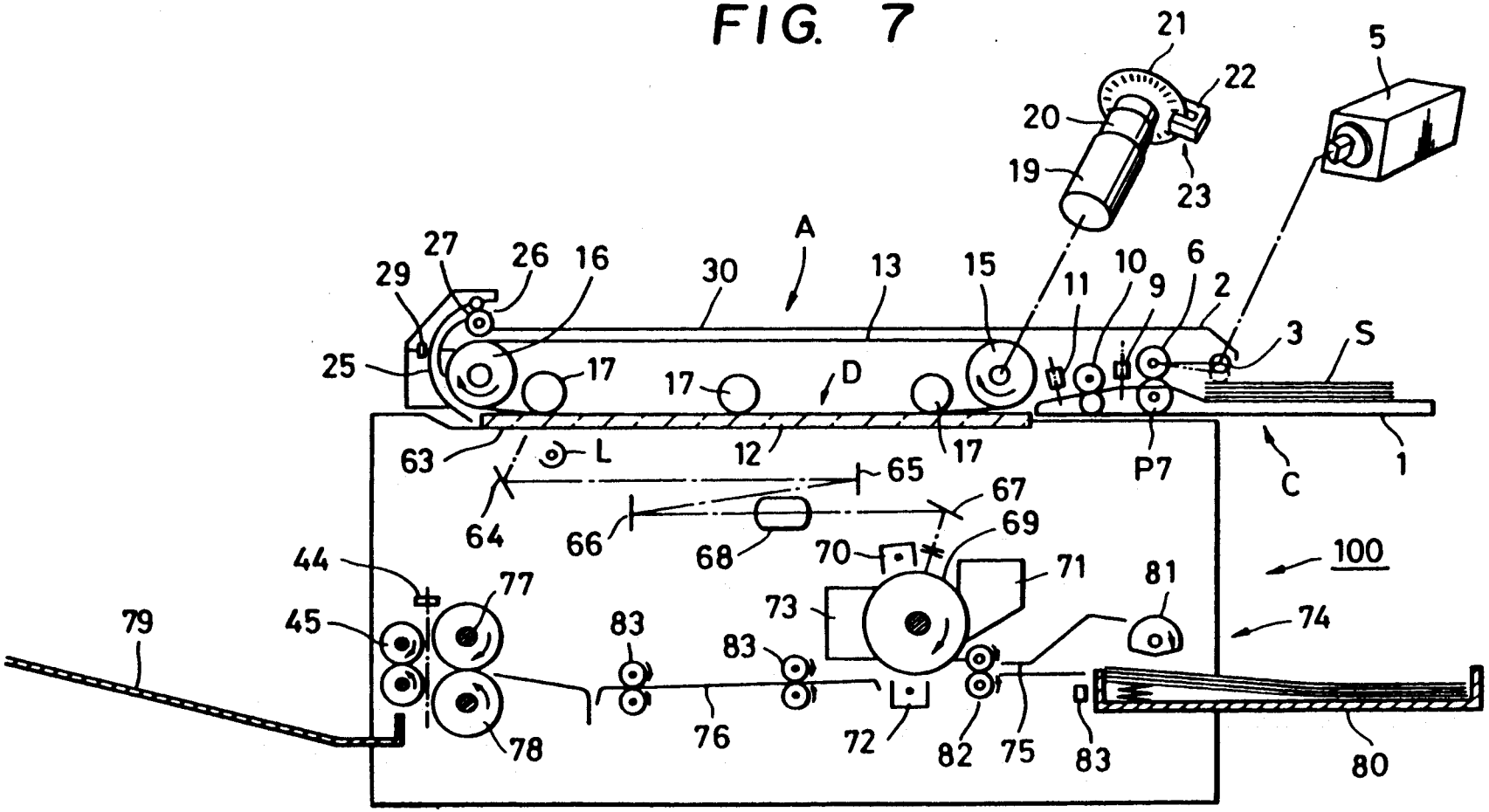
FIG. 7 is an elevational view, partly exploded, of an embodiment which applies the present invention to a copying apparatus.

FIG. 7 shows a copying machine having an automatic original transport device to which the present invention applies. The automatic original transport device is identical to the one shown in FIG. 1, therefore its explanation is omitted.

In FIG. 7 for the copying machine body 100, a known structure can be used and in the present embodiment it comprises a platen glass 12, an optical system having an exposure station 63 which is exposed by a light source L, reflecting mirrors 64–67 and an image forming lens 68, and additionally a photo-sensitive drum 69, a charger 70, a developing station 71, a transfer station 72, a cleaning station 73, a sheet supply station 74, guides for transferred sheets 75 and 76, fixing devices 77 and 78, a pair of sheet discharge roller 45, and a tray for discharged sheets 79.

The sheet supply station 74 comprises a cassette 80 in which sheets are stored, a supply roller 81 which sends out sheets stored in the cassette 80 and a pair of resister rollers 82 which sends out sheets sent out by the supply roller, to the transfer station 72, synchronous with forming of toner image on the photo-sensitive drum 69. A sheet with a toner image on it which was obtained at a transfer station is forwarded by a pair of transport rollers 81 and with the toner image fixed on its surface by the fixing rollers 77 and 78, the sheet is discharged onto the discharge tray 79 by the discharging roller 45.

In the meantime, an original which was sent out by the pick-up roller 3 from a supply sheet tray 1, as aforementioned, is forwarded to a particular position on the platen 12 by the transport belt 13 and stops there. When the original stops at that position on the platen 12, an image of the original is formed on the photo-sensitive drum 69 by the reflecting mirrors 64–67 and the image forming lens 68 and a latent image is obtained. The photo-sensitive drum 69 rotates in the direction indicated by the associated arrow, and the latent image is developed to a toner image at the developing station 71 and transferred as mentioned above.

In the above embodiment the sensor 44 for discharged sheets is placed upstream of the rollers 45, and a motor which drives the rollers 45 after detection of the trailing edge of the discharged sheet by the sensor 44, is controlled according to the flowchart shown in the FIG. 3 or FIG. 4. A sheet size may be detected with a clock-generator, but it may also be detected by a detecting sensor 83 for detecting a sheet size from the cassette 70. Though in the above embodiment a pair of discharge rollers was adopted, a belt-conveyor may also be used.

As explained above, according to the present invention, in an image forming device or an automatic original transport device attached to it, the transport condition is variably controlled at the time of discharging a sheet on a discharge tray in accordance with sheet size. Therefore in the case of either small or large size sheets, difficulties such as flying too far or folding can be prevented and originals can be surely aligned.

Since for aligning sheets it is not necessary to utilize the fall of sheets by their own weight, thanks to variable control of the transport condition at the time of discharge, the slant of the discharge tray can be made small and the overall device can be made compact.

If variable control of the timing of reduction of the speed is chosen, the control is easy. On the other hand, if variable control of discharge speed is chosen, the discharge of sheets is stabilized and aligned well.

Figure 8:
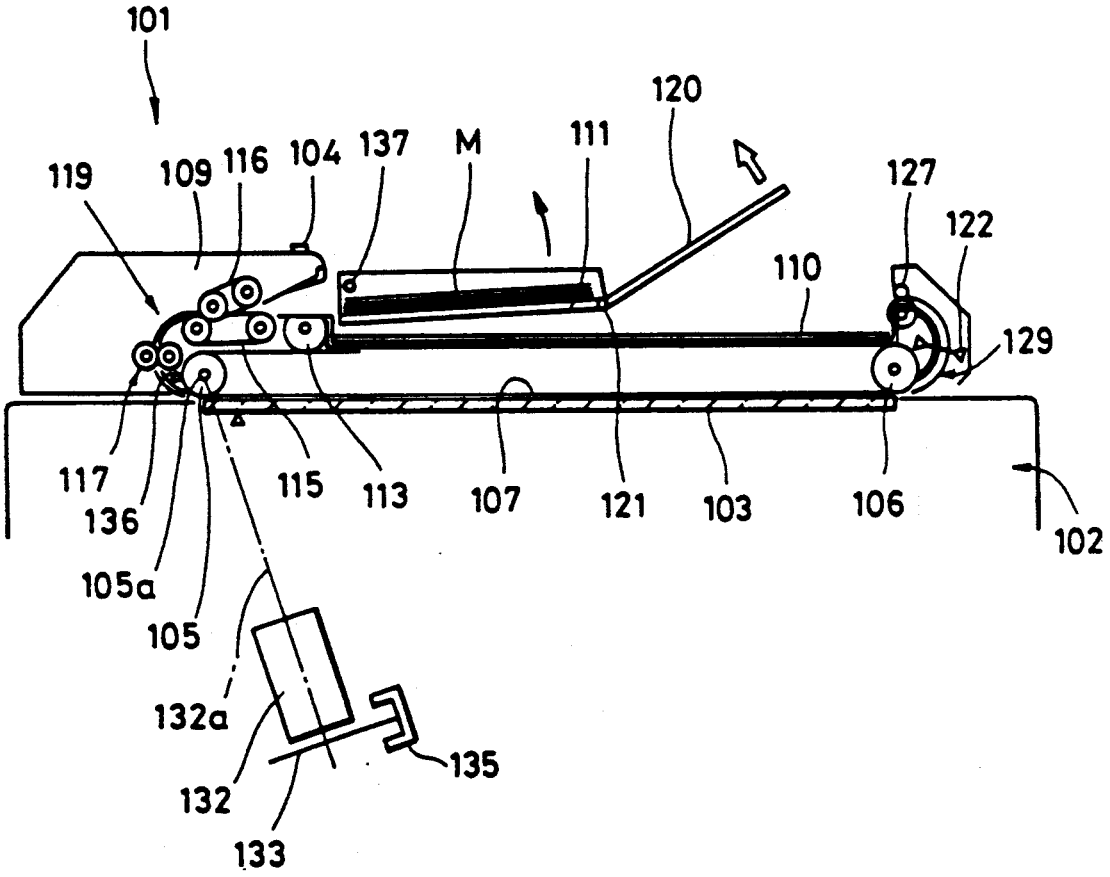
FIG. 8 is a similar view showing an original transport device with respect to another embodiment.

FIG. 8 shows another automatic original transport device 101 which is mounted on the upper part of a copying machine 102 and has a transport belt 107 which is wider than transported originals and is wound over a platen 103 between a drive roller 105 and an idler roller 106. To an axle 105*a* of drive roller 105, one end of a shaft 132*a* of a motor 132 is connected. Additionally, a clock-disc 133 is fixed at the other end of shaft 132*a* and close to that clock-disc 133 is provided a photointerrupter 135, which counts the number of slits of the clock-disc 133.

The automatic original transport device 101 has a tray 111 for paper supply shown loaded with originals M, the tray being pivotably supported by a hinge 137. Downstream of the tray 111 are provided a roller 113 which sends out the lowest originals M placed on the tray 111 one by one, a transport belt 115 which rotates counterclockwise and transports the originals M, a separation belt 116 which rotates counterclockwise and separates the originals M one by one, a pair of transport rollers 117 for transporting the originals M and a sensor 136 for sensing sheet ends. The above constitutes a supply path 119 for supplying and transporting originals M to the platen 103. Additionally, to the right of the above transport belt 107 a U-formed path 129 for paper discharge is provided and in this path 129 are provided a sensor 122 which detects discharge of the originals M and a pair of rollers 127 which discharges the original M to the tray 110. Downstream of the pair of rollers 127, the tray 110 is disposed and this tray also serves as a digitizer for establishing copy area. The upper surface of the device body may constitute the tray. The digitizer uses a lead pen and two sheets of resistances for reading in a horizontal (X) direction and lengthwise (Y) direction, respectively. On its surface is provided a protection sheet which may be formed of synthetic resins and its base is an electric conductor. When two points on its surface which designate a desired copy area, are pressed with the lead pen, the two resistance sheets generate a voltage corresponding to the pressed portions. Thus the copy area of the original is read and only the designated area can be extracted from the original which is placed on the platen.

Figure 9:
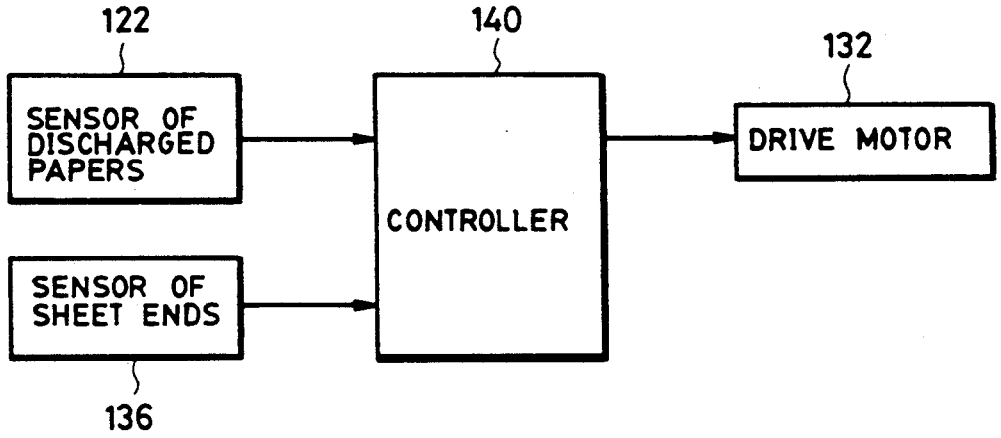
FIG. 9 is a block diagram showing the control means with respect to the embodiment of FIG. 8.

On the other hand, the original transport device 101 has a controller 140 as shown in FIG. 9, to the input portion of which a sensor 122 and a sensor 136 for sheet ends are connected. Additionally, the motor 132 drives the pair of rollers 127 under control of the controller 140.

According to this embodiment, in case of transporting an original M of small size, a subtray 120 is closed in the arrow direction, the tray 111 for paper supply is moved to a loading position and a start key of the copying machine 102 (not shown) is pressed and then the paper supply roller 113 begins to rotate and sends out the lowest one of originals M. The original M is separated and transported by a transport belt 115 and separation belt 116 from the stack of originals one by one, transported by the pair of transport rollers 117, and is inserted between the transport belt 107 and platen 103. There the control part 140 obtains data of the transported length of the original from the time that the sensor 136 of the sheet end detects the leading edge of the original M until it detects the trailing edge thereof, by counting the number of pulses generated by the clock-disc 133 and photointerrupter 135.

Figure 10:
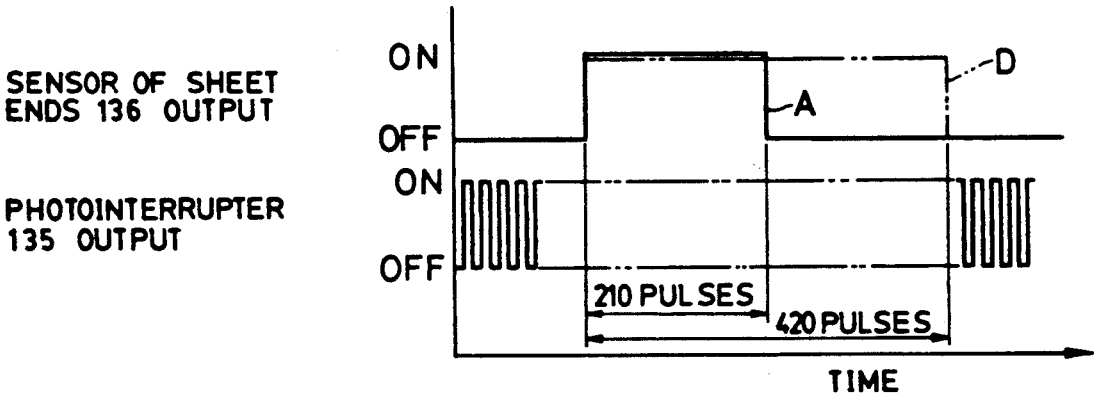
FIGS. 10, 11 (*a*) and 11 (*b*) are timing charts showing the operation of the embodiment in FIG. 8.

For example, as shown in FIG. 10 by a solid line, if the number of clock pulses generated while the sensor 136 is ON, is 210 pulses, the original M is found to be a size A4. In this case one pulse is set up to constitute 1 mm. After that, with the rotation of the belt 107, the original M is placed onto a basis point on the platen 103 for placing the original which is not shown in the Figure and copied in a copy part of the copying machine 102 which is not shown in the Figure. Then, after being copied, the original M is transported to the right by the transport belt 107 which is driven by the driving rollers 105, and is inserted into a pair 129 of winding guides. Then when the leading edge of the original M is detected by the sensor 122, the control part 140 which receives an ON signal from the sensor 122, compares the length of the original M in the direction of transport (210 mm) with the set value (e.g. 250 mm). When the set value is greater, the original M is discharged onto the tray 110 for discharged papers at a normal discharge speed B (see FIG. 11 (*a*)) by the pair of discharging rollers 127. Besides, if the discharge speed is slowed down at the final stage of paper discharge as shown by a broken line C in FIG. 11 (*a*), alignment of the original M is improved. Since the period in which the discharge speed is slowed down is momentary, it does not decrease the entire processing speed.

On the other hand, when the original M of large size is transported, an operator opens the subtray 120, places the original M onto the tray 111 for paper supply and it is supplied and transported in a similar manner to that mentioned above. The length of the original M in the direction of transport (e.g. 420 pulses, namely 420 mm as shown by a chain line D in FIG. 10) is detected in a similar operation to that mentioned above. Then after the process is finished, when a leading edge of the original M is detected by the sensor 122 at the time of its discharge, the control part 140 which receives an ON signal from the sensor 122, compares the length of the original M in the direction of transport (420 mm) with a set value (250 mm). When the length in the direction of transport is judged to be longer than the set value, the input voltage of the driving motor 132 is decreased to rotate the pair of discharging rollers 122 at a low speed (see FIG. 11 (*b*)) and a coiling of the discharged original M is prevented.

Figure 11:
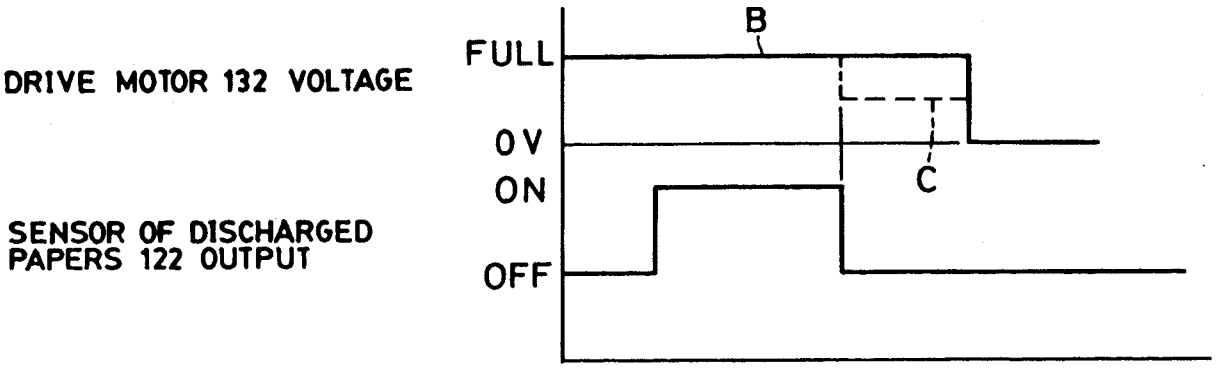
Figure 11:
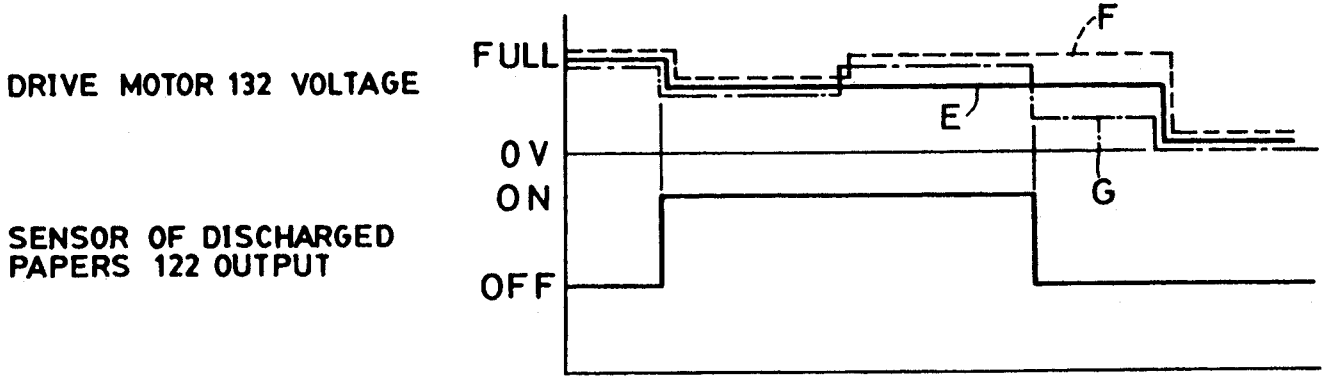

Additionally, while the original of large size is being discharged, at the time when the danger of coiling or collision of the original M with the subtray 120 disappears, the discharge speed can be returned to the normal speed as shown in a broken line F (see FIG. 11 (*b*)). With this treatment the processing speed can be increased. Besides, if the discharging speed is again slowed down at the final stage of paper discharge as shown by a chain line G (see FIG. 11 (*b*)), the alignment of the original M is improved. While in the above embodiment the discharge speed of the pair of discharging rollers 127 is controlled by increase and decrease of the input voltage to the driving motor 132, apart from that, the duty of electric power on the motor 132 may be chopper-controlled.

While in the above embodiment the pair of discharging rollers 127 is connected with the driving motor 132, the pair of rollers 127 may be provided with a special motor which is to be controlled.

Moreover, while in the above embodiment, the size of the original M is detected only with respect to its length, it may be detected with respect to both its length and its width.

Moreover, in the above embodiment the length of the original M is classified into large and small size and the discharge speed is controlled accordingly; but the discharge speed and timing may be controlled continuously without steps.

Moreover, while in the above embodiment the original transport device 101 is described as an example, the present invention is not limited to such an original transport device 101 but can be applied to various kinds of original transport devices.

As explained above in case a thin sheet of large size which is easy to bend is discharged, by slowing down the discharge speed of the sheet, the sheet is prevented from turning up due to air currents, coiling or jamming.

When the sheet is detected by the detector to be larger than the predetermined size, if at an early stage the sheet is discharged at a lower speed than the sheet which size is smaller than the predetermined size and at a later stage is discharged at a higher speed than at the early stage, the overall processing speed is improved.

Figure 12:
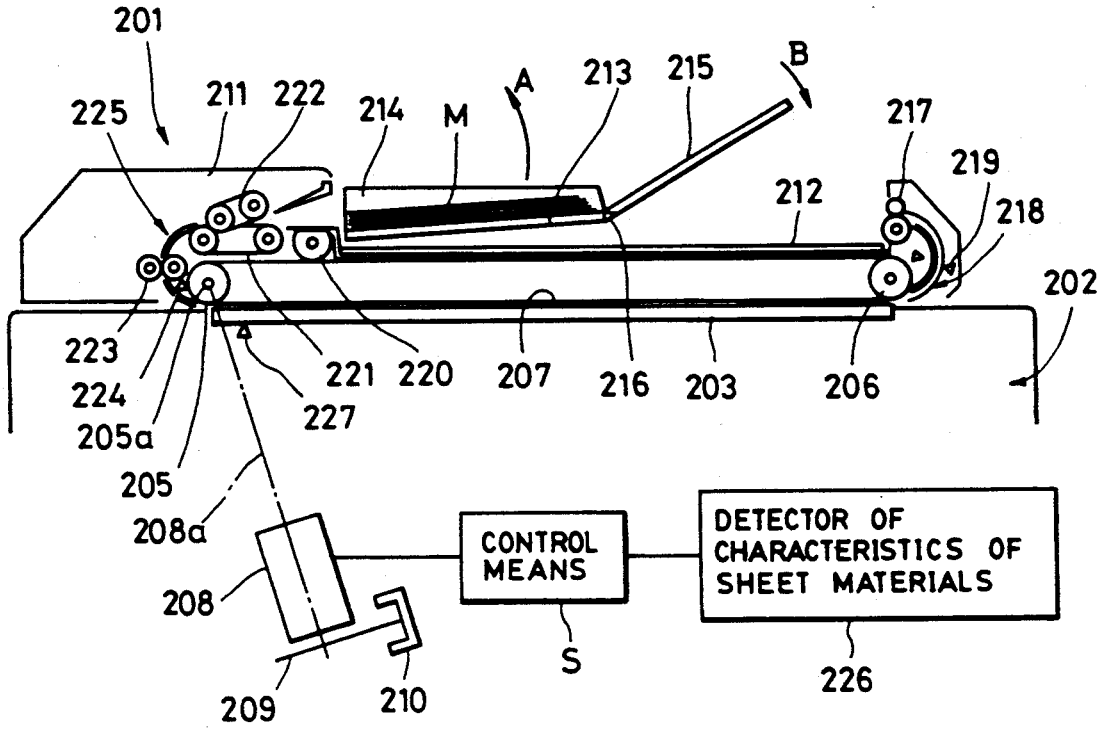
FIG. 12 is an elevational view similar to FIG. 8 of an original transport device with respect to the other embodiment of a sheet discharging device.
Figure 26:
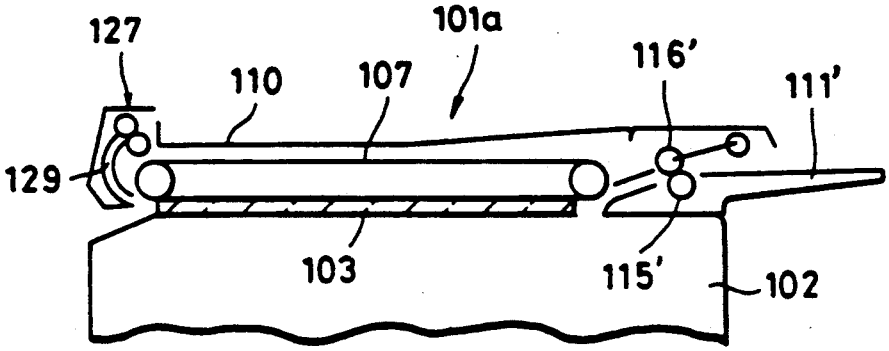
FIGS. 26–30 are examples of publicly known sheet discharging devices.
Figure 27:
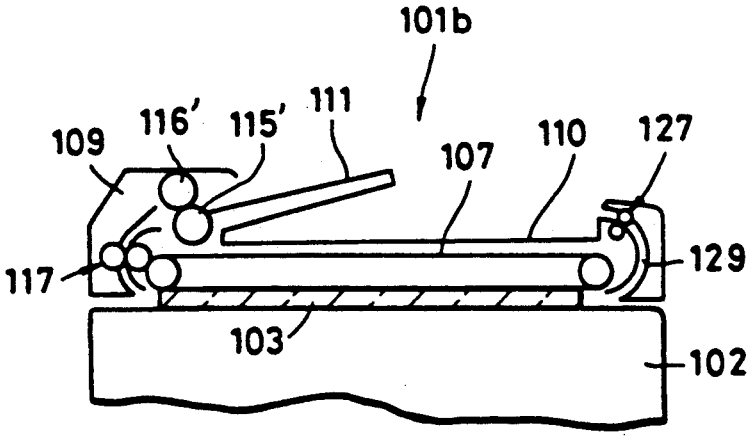
Figure 28:
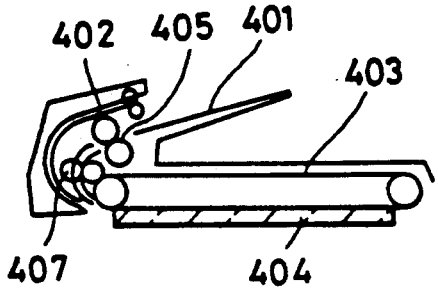
Figure 29:
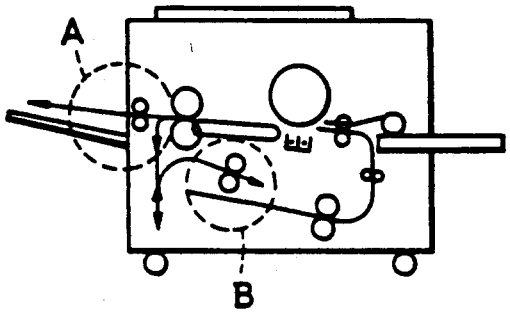
Figure 30:
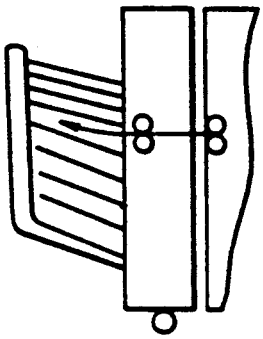

When the sheet is detected by the detector to be larger than the predetermined size, if at an early stage it is discharged at a lower speed than the sheet which size is smaller than the predetermined size, at an intermediate stage it is discharged at a higher speed than at the early stage, and then at a last stage it is discharged at a lower speed than at the intermediate stage, then alignment of sheets will be improved. FIG. 12 indicates another original transport device 201 mounted on a primary body of a copying machine 202. Here the original transport device 201 is explained with the known example of FIG. 27, however, devices of FIG. 26 and FIG. 28 are also possible.

The original transport device 201 is placed above the copying machine 202 and has an endless belt 207 which is wound between a driven roller 205 and an idle roller 206 over a platen 203. To an axle 205*a* of the roller 205 one end of a shaft 208*a* of a motor 208 is connected and a clock-disc 209 is fixed at the other end of the shaft 208*a*.

Close to the clock-disc 209 a photointerrupter 210 is placed, to count the number of slits of the clock-disc 209 and this controls the length of movement of the belt 207. Additionally, a tray 212 for discharged papers which receives originals after the whole process is finished, is mounted in the body 211 above the belt 207.

A tray 213 for paper supply is pivotally supported by a hinge 214 and by rotating the tray 213 in the direction of an arrow A the original on the tray 212 for discharged papers becomes easier to remove. Besides, on the tray 213 a subtray 215 is pivotally mounted, by a subtray hinge 216. When the original of a large size is in process, the tray 213 is rotated in the direction of arrow B to increase its size for the large size original. Downstream of the belt 207 are provided a pair of winding guides 218 and a paper discharging roller 217 which discharges the original M transported by the belt 207. Within the winding guide 218 is provided a sensor 219 for discharged papers which detects the leading and trailing edges of the original.

To the left of the tray 213 for paper supply are provided a supply roller 220 which supplies and sends out the lowest of the originals M placed on the tray 213, a transport belt 221 which rotates counterclockwise and transports the original M, a separation belt 222 which rotates counterclockwise and separates the originals M one by one, a pair of transport rollers 223 which transports the original M and a sensor 224 which detects the leading and trailing edges of the original M. This arrangement constitute a transport path 225 which supplies the original M onto the platen 203.

Figure 13:
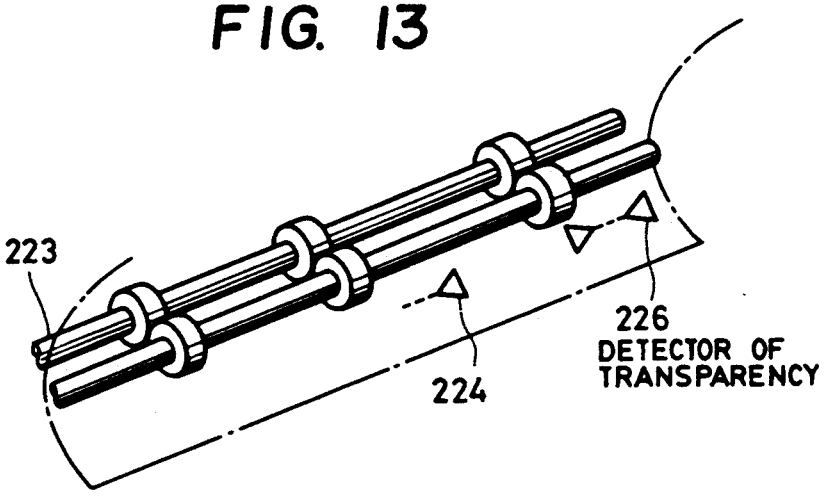
FIG. 13 is an enlarged view of an essential part of FIG. 12.

As shown in FIG. 13, close to the pair of transport rollers 223 a transparency detecting sensor 226 is provided which constitutes means for detecting characteristics of sheet materials. The sensor 226 looks in the direction of the breadth of the paper, on the same basis side of the original as the above sensor 224 because there is less noise at the edge of the originals than at its other parts.

The sensor 226 may be a transmission type sensor which detects transparency of the original which passes through the paper supply path and judges whether it is a thin original in which turning up and coiling is apt to occur.

When the tray 213 for paper supply is closed and a start key of the copying machine 202 (not shown) is pushed, the roller 220 starts to rotate and supplies the originals M from the lowest original one by one. The lowest original M is separated and transported from the lowest side to the transport belt 221 and separation belt 222 one by one. Further, the original M is transported to the pair of transport rollers 223 and placed between them and then inserted between the belt 207 and the platen 203. After that the original M is placed, by rotation of the belt 207, onto the platen at a location determined by basis point 227 and copied by a copy part of the copying machine 202. After the copying process, the original M is transported to the right by the belt 207 which is driven by the driving roller 205 and further through the pair of winding guides 218, is placed between the pair of discharging rollers 217 and discharged onto the tray 212 for discharged papers.

Now the original transport device 201 controls its discharge speed dependent on transparency of the original, the degree of transparency being related to the thickness of the sheet. There follows an explanation of the operating process of this embodiment.

A-1. When a start key of a copying machine 202 is pushed to ON, transport belt 221 and separation belt 222 start operating and separate the lowest originals one by one.

A-2. The first original enters transport path 225 and is inserted by the pair of transport rollers 223 between the belt 207 and platen 203.

Figure 14:
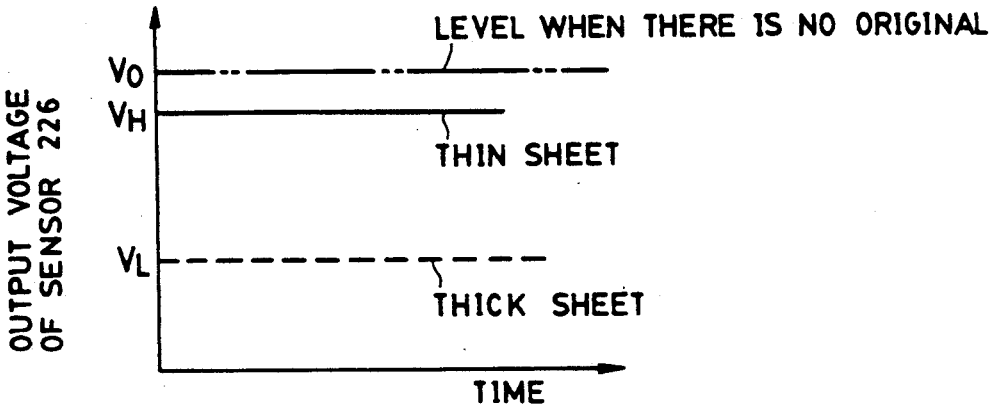
FIG. 14 is a chart showing output voltage of a sensor.

A-3. By rotation of transport rollers 223 and belt 7 the original is placed on a platen 203, as described. When the original passes through transport path 225, its transparency is detected by the transparency detecting sensor 226. For instance, transparency is detected by checking the output voltage of the transparency detecting sensor 226. FIG. 14 shows levels of each output voltage in the cases of thin and thick originals which are passing through transport path 225. The level is Vo when no original is present, the level is VH when the original is a thin sheet (e.g. 529/m2) and the level is VL when it is a thick sheet (e.g. 105 g/m2). Namely, when above output voltage is inputted into control means S such as a CPU, the sheet is judged to be thin if the output level becomes high and judged to be thick if the output level becomes low. This information controls discharge speed.

A-4. The original is reproduced by the copy part of the copying machine 202.

A-5. The original is transported to the right by the overall belt 207 and enters the winding guide pair 218.

Figure 15:
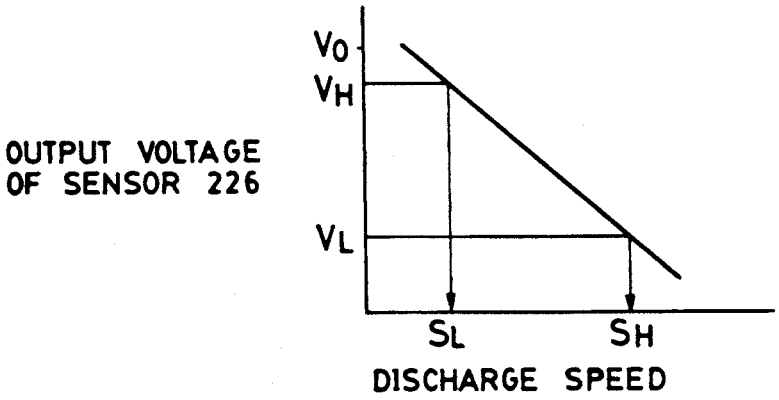
FIG. 15 is a chart showing the relation between the output voltage of a sensor in FIG. 13 and controlled discharge speed.
Figure 16:
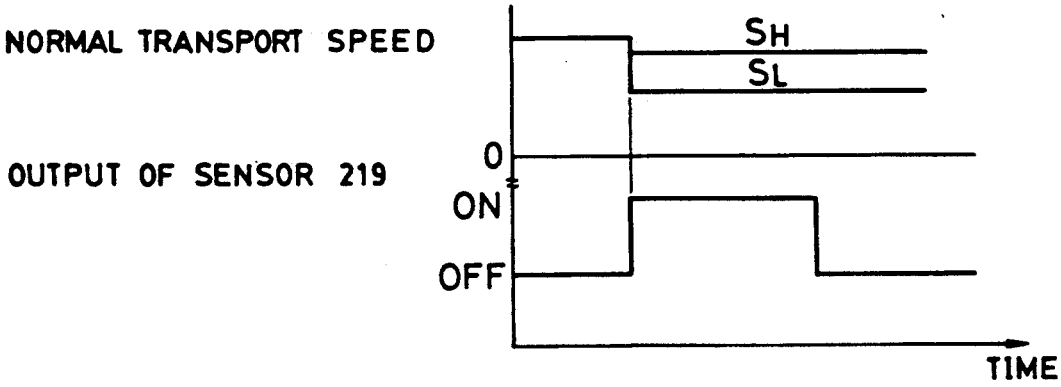
FIG. 16 is a discharge speed timing chart.

A-6. When the leading edge of the original reaches sensor 219, control of discharge speed starts. The sheet discharge speed is determined by the output level of the transparency detecting sensor 226 which is detected as above in A-3. FIG. 15 shows the relation between discharge speed and output level of the transparency detecting sensor 226. When the sheet is thin (52 g/m2), output level is VH, discharge speed is SH and the sheet is discharged at a relatively low speed. When sheet is thick (105 g/m2), output level is VL, discharge speed is SH and the sheet is discharged at a relatively high speed. That is, when the sheet is thin, it is quite possible that turning-up, coiling or the like of sheets may occur, therefore the sheet is discharged at a low speed. To the contrary in the case of a thick sheet in which little turning-up, coiling or the like are likely to occur, priority is given to the discharge speed of the originals and decline in productivity is prevented by discharging the sheet at a high speed. FIG. 16 shows the timing between the output of the sensor 19 and the discharging speed.

A-7. When the original is completely discharged onto the tray 212, supply of the next original starts and the same operations are repeated until the originals in the tray 213 for paper supply run out.

The change of discharging speed in A-6 above may be realized by change of the rotation of motor 208 using output voltage, or it may be realized by chopper-control of the duty to the motor.

In the above-mentioned embodiments, the discharging speed is controlled and changed over a whole area of transparency according to the transparency of the originals. However, in the previous embodiment a specific value of transparency is fixed, and if that value is exceeded, the discharging speed may be controlled similarly to the above embodiment and if it is less than that value, a sheet is discharged at a constant discharge speed.

Figure 17:
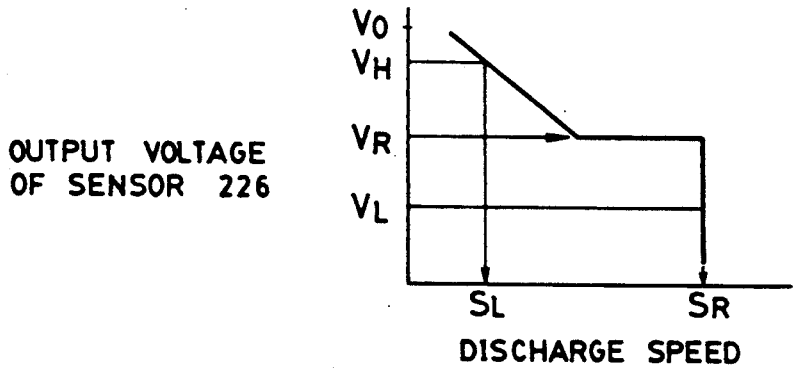
FIGS. 17 and 18 are charts showing the relation between the output voltage of the sensor and the discharge speed.

FIG. 17 shows a relation of transparency, namely the output level of the transparency detecting sensor 226 and the discharge speed. In this case, if the output level is less than fixed level VR, all discharge speeds are fixed constantly at SR. The inventors found by experiment that it is preferable to fix the above level at an output between levels of 50 g/m2 and 60 g/m2. With this arrangement, productivity can be improved without unnecessarily reducing discharge speed of a little less transparent (namely thick) originals, for example those of 60 g/m2 or 80 g/m2.

Figure 18:
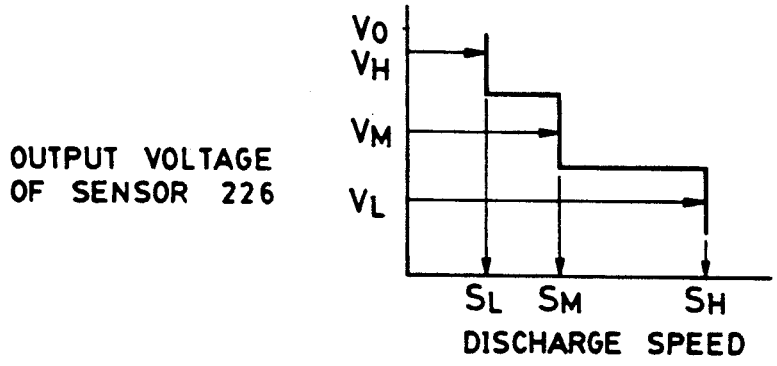

Besides, a plurality of constant values can be fixed as shown in FIG. 18 and discharge speed can be changed in stages.

Since the frequency of turning-up or coiling of the original depends upon the thickness of the original (which is detected by transparency), the above embodiments prevent its turning-up or coiling and further prevents jamming of originals caused by such turning-up.

The next example is an embodiment in which characteristics that are to be detected are not only sheet thickness but also include its size. An example in which an original transport device has means for detecting the size of originals is explained in accordance with the process A-1 to A-7 of the above-mentioned embodiment.

A-1, A-2, and A-3 are the same as in above-mentioned embodiment.

Figure 19:
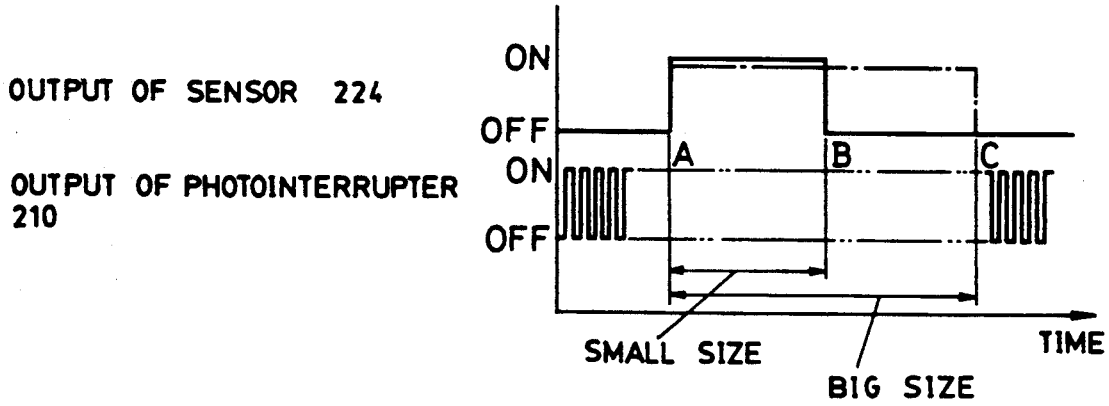
FIG. 19 shows the relation between output of the sensor in FIG. 12 and a photointerrupter.

A-3'. When an original passes through a transport path 225, transparency is detected as mentioned in A-3 above and simultaneously the size of the original is detected by the sensor 224. Namely, length of the original transported from the time its leading edge reaches the sensor 224 until its trailing edge passes through, is counted with a clock-disc 209 and photointerrupter 210. FIG. 19 shows the relation between the output of the sensor 224 and the photointerrupter 210. When the sensor 24 is turned ON, clock-pulses of the photointerrupter 210 are counted. For example, in the case of a small size original, the output of the sensor 224 is indicated by a solid line and clock-pulses from A to B are counted. On the other hand, in the case of a large size original its output is indicated by a chain line and clock-pulses from A to C are counted. Accordingly, the size of the original is detected and with this information and information concerning its transparency in A-3 above, the discharging speed is controlled.

A-4 and A-5 are the same as in previous embodiment.

A-6'. When the leading edge of the original reaches the sensor 219, control of discharge speed starts. The manner of controlling the speed is determined by the size of the original and its transparency as mentioned above in A-3 and A-3'.

Figure 20:
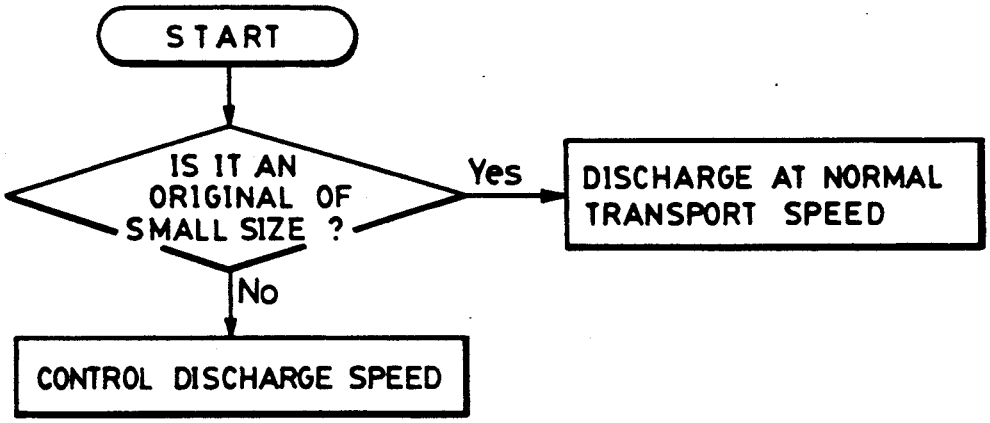
FIG. 20 is a flow chart illustrating discharge control used in the other embodiment.

FIG. 20 shows a flow-chart which illustrates the above determination. In the first stage of this chart, information concerning size of the original is judged and when this information indicates that the same is small according to A-3', the discharge speed is not controlled and the original is discharged at a regular speed, for in the case of the originals of small size even if its transparency is high (namely thin), turning-up or coiling rarely happens and an unnecessarily long original discharge time has to be avoided. When the information concerning size of the original indicates large, control of the discharge speed starts, as above in A-6.

Figure 21:
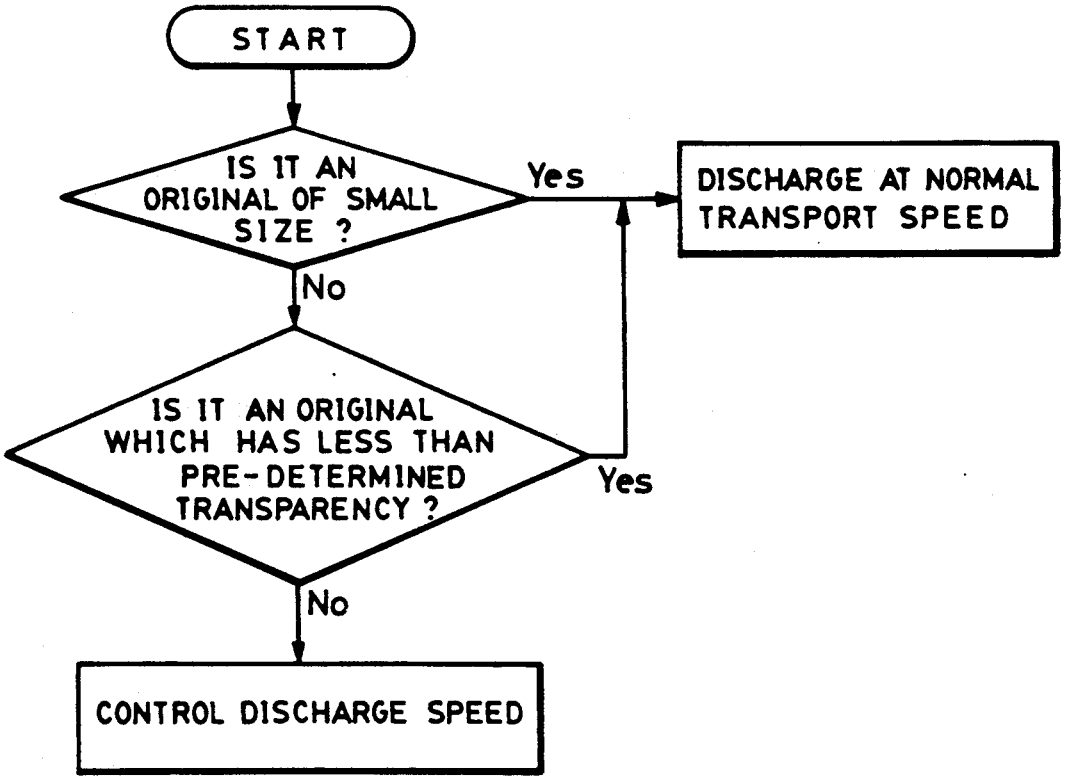
FIG. 21 is a variation of the flow chart of FIG. 20.

As to A-7' it is the same as in the previously mentioned embodiment. While in above example the discharge speed is controlled in the way described in A-6' above, the original can be discharged without control (FIG. 21), when transparency is less than the fixed value or a plurality of constant values can be fixed and the discharge speed can be changed in stages, as explained in FIGS. 17 and 18.

Additionally, while in the above embodiment, the size of the original is first judged, other embodiments are also possible. Namely, there may first be a judgment according to its transparency and the original, the transparency of which is less than the fixed value, is discharged at the regular transport speed. After that there is a judgment according to its size and when the size of the original is less than fixed value, it is discharged at the regular transport speed and when the size of the original is more than fixed value, its discharging speed is controlled and it is discharged at a lower speed.

According to the above embodiment, as characteristics of the original, not only its transparency but also its size are detected, the discharge speed of the original can be more delicately controlled, the original can be favorably discharged, and productivity of printed matters can be improved.

Figure 22:
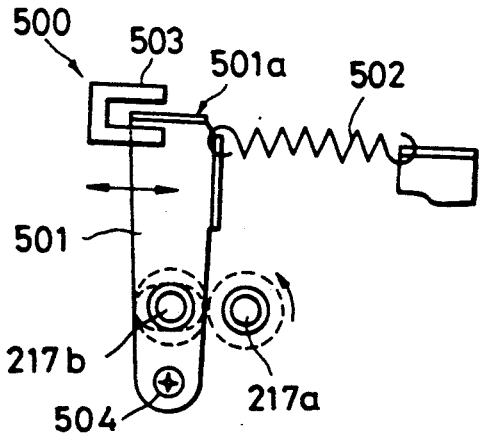
FIG. 22 is a thickness detecting means which detects thickness of sheets.

As shown in FIG. 22, instead of the transparency detecting means 226, a thickness detecting means 500 can be utilized which detects directly the thickness of the sheet. This thickness detecting means is provided in connection with a pair of transport rollers 217*a* and 217*b* similar to rollers 217 of FIG. 12. The thickness detecting means 500 comprises the pair of transport rollers 217*a* and 217*b*, an accessory board 501, a spring 502 an a sensor 503. A lower end of the accessory board 501 is pivotally supported by a pin 504 as a pivot axis. In the middle of the board the dependent transport roller 217*b* is mounted for rotation and, with the spring 502 which is placed at the upper edge of the accessory board 501, the roller 217*b* is pressed to the transport roller 217*a* which drives the other side. At the upper end of the accessory board 501 a flag element 501*a*is provided, which can move into and out of a sensor 503.

Figure 23:
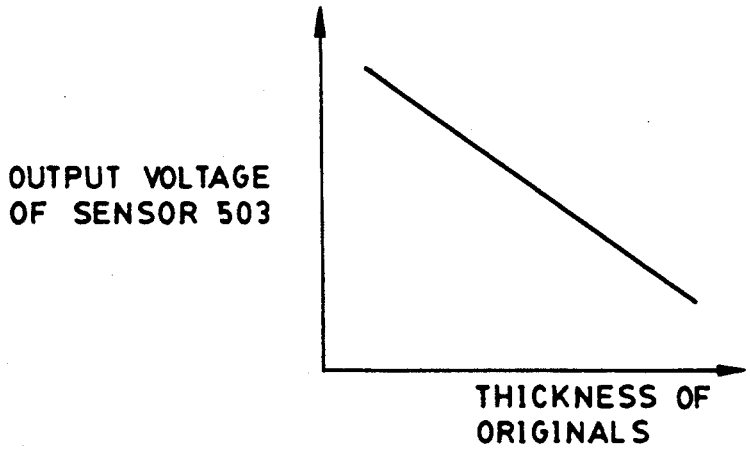
FIG. 23 is a chart showing the relation between the thickness of the original sheet materials and the output voltage of the sensor in FIG. 22.

When an original thick sheet passes between the pair of transport rollers 217*a* and 217*b*, the flag 501*a* moves to the left of the Figure, largely blocks the sensor 503 and lowers the output of the sensor 503 (see FIG. 23). When an original thin sheet passes between the above rollers, the output of the sensor 503 is greater than in the case of the thick sheet. Thus, the thickness of the original is detected and it is judged whether or not turning-up or coiling can be caused to the original and discharge control is the same as above-mentioned. Combining the thickness detecting means 500 with the size detecting means is also possible as will be appreciated by those skilled in the art.

Figure 24:
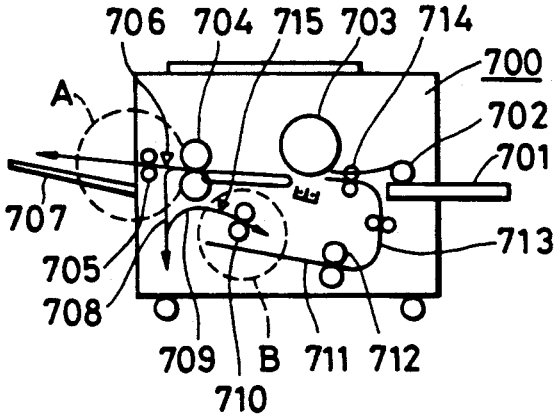
FIG. 24 shows another embodiment in which the present invention is applied to a discharge part of a copying machine etc.

FIG. 24 shows the application of the present invention to a copy paper discharging part A of a copying machine body and to a discharging part B of an intermediate tray for both sided copying. In such apparatus, a copy paper is supplied from a copy paper cassette 701 of the body 700 and transported by a transport roller 702. An image on a photosensitive drum 703 is transferred onto the copy paper, fixed at a downstream fixing device 704 and discharged by a discharging roller 705 onto a discharge tray 707. In the case of both sided copying, a copy paper enters a path 708 after it passes through the fixing device 704 and, after making a switch-back, enters the next path 709 and is placed by a discharging roller 710 onto an intermediate tray 711. Then it is transported by a resupply roller 712 to a path 713 and discharged to a tray 707 for discharged papers.

In the above device a transparency detecting sensor 715 is placed upstream of the discharging sensor 706 and of the discharging roller 710 for the intermediate tray. Since the detected data by the sensors 706 and 715 control respective discharging rollers 705 and 710, the discharging conditions of the discharging tray 707 and intermediate tray 711 are favorable. Details about its control are the same as in above-mentioned embodiment. Besides a register roller 714 of the primary body may be provided with the thickness detecting means shown in FIG. 22 and according to the data detected by that, the discharge by the discharging rollers 705 and 710 may be also controlled. Its details are the same as in the above-mentioned embodiment.

Figure 25:
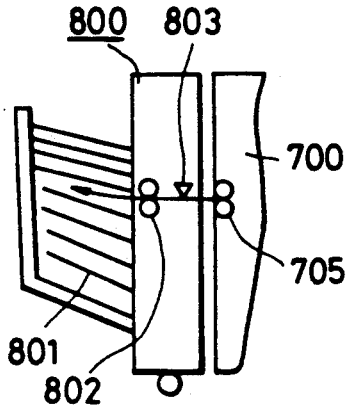
FIG. 25 explains an embodiment in which the present invention is applied to a sorter of a copying machine.

FIG. 25 shows an embodiment in which the present invention is applied to a sorter attached to a copying machine or the like. In this embodiment, a copy paper from a primary body 700 is transported by a discharging roller 705 and discharged onto bins 801 in order by a discharging roller 802 within a sorter 800. In this device a transparency detecting sensor 803 is placed upstream of the discharging rollers 802 and according to the data detected by that sensor, discharge by the rollers 802 is controlled. Details about its control are the same as in above-mentioned embodiment.

Additionally, the register roller 714 of the primary body may include the thickness detecting means and according to the data detected by that, the discharge by the discharging roller 802 to the sorter can be controlled. The details about its control are the same as in above-mentioned embodiment.

As explained above, in case discharge of the sheet is controlled according to the characteristic of the sheet detected by the characteristic detecting means, it can be discharged in a proper manner (e.g. at a proper discharge speed) according to that characteristic of the sheet (e.g. transparency (thickness) or size). Therefore the sheet can be discharged favorably without turning-up, coiling, jamming or the like.

What is claimed is:

1. An image reading device comprising, means for forwarding originals, image reading means for reading images on the originals forwarded by said forwarding means, means for discharging the originals the images on which were read by said reading means, an original support for receiving originals discharged by said discharging means, a detector for detecting the length of an original to be discharged by said discharging means and for transmitting a detection signal and means for controlling said discharging means according to the detection signal sent by said detector, wherein said controlling means is constructed and arranged to control said discharging means at least a first discharging speed, a second discharging speed which is lower than the first discharging speed, and a third discharging speed which is lower than the second discharging speed.

2. A device according to claim 1, where said sheet support includes a tray for receiving sheets.

3. A device according to claim 1, wherein said discharging means has a roller for transporting sheets.

4. A device according to claim 1, wherein said discharging means has a pair of rollers which transport a sheet placed in the nip therebetween.

5. A device according to claim 1, wherein said detector has means for counting the passage of time during which a transported sheet passes a point along its path.

6. A device according to claim 1, wherein said control means changes the discharging speed of a sheet based on the detection signal transmitted by said detector.

7. A device according to claim 6, wherein the greater the length of a sheet detected by said detector, the greater its discharging speed.

8. A device according to claim 6, wherein a sheet which is determined by the said detector to be greater than a predetermined size is discharged at a lower speed than a sheet which is determined to be shorter than the predetermined size.

9. A sheet discharging device comprising, a sheet support for discharged sheets, means for discharging sheets onto said sheet support, a detector for detecting the length of a sheet to be discharged by said discharging means in a discharging direction and transmitting a sheet length detection signal and means for controlling said discharging means according to the detection signal transmitted by said detector, wherein said control means changes the discharging speed of a sheet based on the detection signal transmitted by said detector and wherein a sheet which is determined by the said detector to be greater than a predetermined size is discharged, at an early stage, at a lower speed than a sheet which is determined to be shorter than the predetermined size and, at a later stage, at a higher speed than at the early stage.

10. A sheet discharging device comprising, a sheet support for discharged sheets, means for discharging sheets onto said sheet support, a detector for detecting the length of a sheet to be discharged by said discharging means in a discharging direction and transmitting a sheet length detection signal and means for controlling said discharging means according to the detection signal transmitted by said detector, wherein said control means changes the discharging speed of a sheet based on the detection signal transmitted by said detector and wherein a sheet which is detected by the said detector to be larger than a pre-determined size is discharged at an early stage, at a lower stage than a sheet which is smaller than the pre-determined size, at an intermediate stage at a higher speed than at the early stage, and then at a last stage it is discharged at a lower speed than at the intermediate stage.

11. A sheet discharging device comprising, a sheet support for discharged sheets, means for discharging sheets onto said sheet support, a detector for detecting the length of a sheet to be discharged by said discharging means in a discharging direction and transmitting a sheet length detection signal and means for controlling said discharging means according to the detection signal transmitted by said detector, wherein said controlling means reduces the discharging speed of a sheet while the sheet is passing through said discharging means and said controlling means is constructed and arranged to control said discharging means at least at one of a first discharging speed, a second discharging speed which is lower than the first discharging speed and a third discharging speed which is lower than the second discharging speed.

12. A device according to claim 11, wherein the shorter the length of a sheet detected by said detector, the lower the discharging speed to which the discharging means is reduced.

13. A device according to claim 11 wherein a detector detects the passage of a sheet and transmits a detection signal when a sheet passes by a fixed position, and wherein said controlling means adjusts the discharging speed to a value according to the detection signal.

14. A device according to claim 11 wherein said controlling means changes the discharging speed from the first discharging speed to the second or third discharging speed based on the detection signal, while a sheet is passing through said discharging means.

15. A device according to claim 14, wherein said controlling means changes the discharging speed to the second discharging speed when the length of a sheet detected by said detector is greater than a fixed value and to the third discharging speed when that length is shorter than the fixed value.

16. A sheet discharging device comprising, a sheet support, means for discharging sheets on to said sheet support, a detector for determining the length of a sheet to be discharged by said discharging means in a discharging direction and transmitting a detection signal and means for controlling said discharging means according to the detection signal transmitted by said detector, while a sheet is passing through said discharging means whereby the shorter the sheet length detected, the slower the discharge speed and wherein, where the length of a sheet detected by said detector is greater than a fixed length, said controlling means reduces the discharging speed upon lapse of a fixed time after said pass detection signal is transmitted and, where the length of a sheet detected by said detection is shorter than a fixed length, said controlling means reduces the discharging speed upon lapse of a second fixed time which is shorter than said fixed time after said pass detection signal is transmitted.

17. A device according to claim 16, wherein said detector has means for counting the passage of time during which a transported sheet passes a point on its path.

18. A device according to claim 16, wherein said sheet support includes a tray for receiving sheets.

19. A device according to claim 16, wherein said discharging means has a roller for transporting sheets.

20. A device according to claim 16, wherein said discharging means has a pair of rollers which transport a sheet placed in the nip therebetween.

21. A device according to claim 16, wherein said controlling means reduces the discharging speed of the discharging means on the basis of said pass detection signal to a speed determined by the length of a sheet detected by said detector means.

22. A device according to claim 21, wherein said controlling means reduces the discharging speed whereby, the shorter the length of a sheet detected by said detector, the lower its discharge speed.

23. A sheet discharging device, comprising means for discharging a sheet to a certain position, information generating means for generating information as to flexible rigidity of the sheet and means for controlling sheet discharge at a discharge speed according to the information generated by said information generating means, wherein said control means changes the discharging speed of a sheet based on the information generated by said information generating means.

24. A sheet discharging device according to claim 23, wherein said information generating means comprises a detector detecting a level of transmittance of a sheet, and wherein said controlling means changes the discharging speed by said discharging means according to the level of transmittance of a sheet detected by said detector.

25. A sheet discharging device according to claim 24, wherein said controlling means sets the discharging speed of said discharging means at a first speed when the level of transmittance of a sheet detected by said detector is within a first range, and at a second speed when said level is with a second range.

26. A sheet discharging device according to claim 25, wherein a sheet having the level of transmittance within the first range transmits a light easier than that within the second range.

27. A sheet discharging device according to claim 26, wherein the first speed is slower than the second speed.

28. A device according to claim 23, further comprising a sheet support for discharged sheets, said sheet support including a tray for receiving sheets.

29. A device according to claim 23, wherein said discharging means has a roller for transporting sheets.

30. A device according to claim 23, wherein said discharging means has a pair of rollers which transport a sheet placed in the nip therebetween.

31. A device according to claim 23, wherein said information gathering means has means for counting the passage of time during which a transported sheet passes a point along its path.

32. A sheet discharging device according to claim 23, where said detector detects sheet length in a transporting direction.

33. A device according to claim 23, wherein the greater the flexible rigidity of a sheet according to said information transmitting means the greater its discharging speed.

34. A device according to claim 23, wherein a sheet identified by said information transmitting means as having a flexible rigidity smaller than a predetermined value is discharged at a lower speed than a sheet which flexible rigidity is greater than the predetermined value.

35. A sheet discharging device according to claim 23, wherein said information transmitting means comprises a detector that detects the thickness of said sheet.

36. A sheet discharging device according to claim 35, wherein said controlling means changes the discharging speed by said discharging means in accordance with the thickness of the sheet detected by said detector.

37. A sheet discharging device according to claim 36, wherein said controlling means sets discharging speed at a first speed when the thickness of a sheet detected by said detector is within a first range, and at a second speed when within a second range.

38. A sheet discharging device according to claim 37, wherein the thickness within the first range is less than that within the second range.

39. A sheet discharging device according to claim 38, wherein the first speed is slower than the second speed.

40. A sheet discharging device comprising:

discharging means for discharging a sheet;

support means for receiving and supporting a sheet discharged by said discharging means;

information generating means for generating information about a length of a sheet in a direction of discharge; and controlling means for controlling said discharging means after sheet discharging has started at a predetermined speed so that the discharge of the sheet is completed at a speed which corresponds to the information generated by said information generating means and is lower than the predetermined speed.

41. A device according to claim 40, wherein said discharging means has a pair of rollers forming a nip therebetween for rolling a sheet.

42. A device according to claim 40, wherein said information transmitting means has means for measuring time necessary in passing a sheet by a predetermined point.

43. A device according to claim 40, wherein said controlling means for changing said discharging speed changes the speed to one of a predetermined plurality of speed ranges.

44. A device according to claim 43, wherein said controlling means changes the sheet discharging speed from a first speed to a second speed when the sheet length according to information transmitted by the information transmitting means is within a first range, and changes from the first speed to a third speed when the sheet length is within a second range.

45. A device according to claim 44, wherein the first speed is faster than the second speed, the second speed is faster than the third speed, and the sheet length within the first range is longer than that within the second range.

46. A device according to claim 45, wherein said controlling means changes the sheet discharging speed from the first speed to the second speed when the sheet length according to information transmitted by said information transmitting means is a first length, and changes from the first speed to the third when the sheet length is a second length.

47. A device according to claim 46, wherein the first speed is faster than the second, the second speed is faster than the third, and the first length is longer than the second.

48. A sheet discharging device comprising:

discharging means for discharging a sheet;

supporting means for receiving and supporting a sheet discharged by said discharging means;

information generating means for generating information about a length of a sheet in a direction of discharge; and controlling means for changing a sheet discharging speed of said discharge means after a time period determined in accordance with the information generated by said information generating means has expired after the sheet has passed a predetermined position.

49. A device according to claim 48, wherein said controlling means changes the sheet discharging speed of said discharging means from a first speed to a second speed when discharging of a sheet starts.

50. A device according to claim 48, further comprising a passing detecting means for generating a signal when a sheet is detected to have passed a predetermined position.

51. A device according to claim 50, wherein said controlling means changes said discharging speed from a first speed to a second speed after the first period from signal generation by said passing detecting means when the sheet length based on the information transmitted by said information transmitting means is longer than a predetermined length, and changes said discharging speed from the first speed to the second speed after the second period from signal generation by said passing detecting means when the sheet length is shorter than the predetermined length.

52. A device according to claim 51, wherein the first period is longer than the second period.

53. A device according to claim 50, wherein there are provided a plurality of predetermined ranges of sheet lengths and said controlling means changes the sheet discharging speed of said discharging means in accordance with the range in which the sheet length according to the information transmitted by said information transmitting means belongs.

54. A device according to claim 48, wherein said controlling means changes said discharging speed from a first speed to a second speed after a first time period from signal generation by said passing detecting means has passed when the sheet length based on the information transmitted by the information transmitting means is within a first range, and changes said discharging speed from the first speed to the second speed after a second time period from signal generation by said passing detecting means when the sheet length is within a second range.

55. A device according to claim 54, wherein the first speed is faster than the second, the sheet length of the first range is longer than that of the second range, and the first period is longer than the second.

56. A device according to claim 48, wherein said discharging means has a pair of rollers forming a nip therebetween for rolling a sheet.

57. A device according to claim 48, wherein said information transmitting means comprises means for measuring the time necessary for passing a sheet by a predetermined point.

58. An image forming device comprising:

an image forming means for forming an image on a sheet;

transportation means for transporting a sheet to said image forming means;

discharging means for discharging a sheet on which an image is formed by said image forming means;

supporting means for receiving and supporting a sheet discharged by said discharging means;

information generating means for generating information about the length of a sheet in a direction of discharge; and controlling means for controlling said discharging means so that the discharge of the sheet is completed at a speed which corresponds to the information generated by said information generating means and is lower than a speed at which the discharge of the sheet started.

59. An image reading device comprising:

reading means for reading an image on the sheet;

transportation means for transporting a sheet to said reading means;

discharging means for discharging a sheet whose image is read by said reading means;

supporting means for receiving and supporting a sheet discharged by said discharging device;

information generating means for generating information about the length of a sheet in a direction of discharge; and controlling means for controlling said discharging means after the discharge of the sheet started at a predetermined speed so that the discharge of the sheet is completed at a speed which corresponds to the information generated by said information generating means and is lower than the predetermined speed.

60. An image reading device comprising:

reading means for reading an image on a sheet;

transporting means for transporting a sheet to said reading means;

discharging means for discharging a sheet whose image is read by said reading means;

placing means for receiving and placing a sheet discharged from said discharging means;

information generating means for generating the information about the length of a sheet in a direction of discharge; and controlling means for changing sheet discharging speed of said discharging means when a period of time set according to the information generated by said information generating means has elapsed after the sheet has passed a predetermined position.

61. An image forming device comprising:

reading means for reading an image of an original;

transporting means for transporting an original to said reading means;

discharging means for discharging an original whose image is read by said reading means;

supporting means for receiving and supporting an original discharged by said discharging means;

information generating means for generating the information about the length of an original in a direction of discharge;

controlling means for changing sheet discharging speed of said discharging means when a period of time set according to the information generated by said information generating means has elapsed after the sheet has passed a predetermined position; and image forming means for forming an original image read by said reading means, onto a sheet.

62. A sheet discharging device comprising:

discharging means for discharging a sheet;

supporting means for receiving and supporting a sheet discharged by said discharging means;

information transmitting means for transmitting information about the length of a sheet in a direction of discharge; and controlling means for changing a sheet discharging speed of said discharging means when a period of time set according to the information transmitted by said information transmitting means has elapsed after the sheet has passed a predetermined position, wherein said controlling means changes the sheet discharging speed from a first speed to a second speed when the sheet length according to the information transmitted by the information transmitting means is within a first range, and changes from the first speed to a third speed when the sheet length is within a second range.

63. A device according to claim 62, wherein the first speed is faster than the second speed, the second speed is faster than the third speed, and the sheet length within the first range is longer than that within the second range.

64. A device according to claim 63, wherein said controlling means changes the sheet discharging speed from the first speed to the second speed when the sheet length according to the information from said information transmitting means is a first length, and changes from the first speed to the third when the sheet length is a second length.

65. A device according to claim 64, wherein the first length is longer than the second.

66. A device according to claim 62, further comprising a passing detecting means for generating a signal when a sheet is detected to have passed a predetermined position.

67. A device according to claim 66, wherein said controlling means changes said discharging speed from a first speed to a second speed after the first period from signal generation by said passing detecting means when the sheet based on the information from the information transmitting means is longer than a predetermined length, and changes said discharging speed from the first speed to the second speed after the second period from signal generation by said passing detecting means when the sheet length is shorter than the predetermined length.

68. A device according to claim 67, wherein the first period is longer than the second period.

69. An image reading device comprising:

reading means for reading an image on an original;

transporting means for transporting an original to said reading means;

discharging means for discharging an original whose image is read by said reading means;

supporting means for receiving and supporting an original discharged by said discharging device;

information generating means for generating information about the length of an original in a direction of discharge;

controlling means for controlling said discharging means after the discharge of the sheet started at a predetermined speed so that the discharge of the sheet is completed at a speed which corresponds to the information generated by said information generating means and is lower than the predetermined speed; and image forming means for forming an original image on a sheet read by said reading means.

70. An image forming device comprising:

image forming means for forming an image on a sheet;

transporting means for transporting a sheet to said image forming means;

discharging means for discharging a sheet to said image forming means;

discharging means for discharging a sheet on which an image is formed by said image forming means;

supporting means for receiving and supporting a sheet discharged by said discharging means;

information generating means for generating information about the length of a sheet in a direction of discharge; and controlling means for changing sheet discharging speed of said discharge means when a period of time set according to the information generated by said information generating means has elapsed after the sheet has passed a predetermined position.

* * * * *

UNITED STATES PATENT AND TRADEMARK OFFICE

CERTIFICATE OF CORRECTION

PATENT NO. : 5,181,705

DATED : January 26, 1993

INVENTOR(S) : NORIYOSHI UEDA, ET AL.

It is certified that error appears in the above-identified patent and that said Letters Patent is hereby corrected as shown below:

COLUMN 2

Line 44, "characteristic" should read --characteristics--.
Line 62, "Further" should read --Further,--.

COLUMN 3

Line 13, "showing" should read --showing the--.
Line 53, "machine" should read --machine,--.

COLUMN 6

Line 11, "embodiment" should read --embodiment,--.
Line 14, "However" should read --However,--.

COLUMN 7

Line 60, "embodiment" should read --embodiment,--.
Line 67, "for detecting a sheet size from" should read --downstream of--.
Line 68, "cassette 70. Though," should read --cassette 70. ¶ Though,--.

COLUMN 10

Line 28, "above" should read --above,--.

COLUMN 11

Line 19, "constitute" should read --constitutes--.

COLUMN 13

Line 53, "example" should read --example,--.

UNITED STATES PATENT AND TRADEMARK OFFICE

CERTIFICATE OF CORRECTION

PATENT NO. : 5,181,705

DATED : January 26, 1993

INVENTOR(S) : NORIYOSHI UEDA, ET AL.

It is certified that error appears in the above-identified patent and that said Letters Patent is hereby corrected as shown below:

COLUMN 14
Line 24, "501ais" should read --501a is--.

COLUMN 15
Line 39, "least" should read --least at--.
Line 44, "where" should read --wherein--.

COLUMN 16
Line 51, "claim 11" should read --claim 11,--.
Line 56, "claim 11" should read --claim 11,--.

COLUMN 17
Line 59, "with" should read --within--.

COLUMN 18
Line 7, "gathering" should read --generating--.
Line 11, "where" should read --wherein--.

Signed and Sealed this

Eighteenth Day of January, 1994

Attest:

Bruce Lehman

BRUCE LEHMAN

Attesting Officer

Commissioner of Patents and Trademarks